US012557877B2

(12) United States Patent
Weast et al.

(10) Patent No.: US 12,557,877 B2
(45) **Date of Patent: *Feb. 24, 2026**

(54) ADJUSTABLE FOOT SUPPORT SYSTEMS INCLUDING FLUID-FILLED BLADDER CHAMBERS

(71) Applicant: NIKE, Inc., Beaverton, OR (US)

(72) Inventors: Aaron B. Weast, Portland, OR (US); Timothy P. Hopkins, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/390,371

(22) Filed: Dec. 20, 2023

(65) Prior Publication Data

US 2024/0115000 A1 Apr. 11, 2024

Related U.S. Application Data

(60) Continuation of application No. 17/316,400, filed on May 10, 2021, now Pat. No. 11,889,890, which is a division of application No. 16/425,356, filed on May 29, 2019, now Pat. No. 11,039,661.

(60) Provisional application No. 62/678,662, filed on May 31, 2018.

(51) Int. Cl.

| | |
|---|---|
| ***A43B 13/20*** | (2006.01) |
| ***A43B 13/18*** | (2006.01) |
| ***A43B 17/03*** | (2006.01) |

(52) U.S. Cl.

CPC ..... *A43B 13/203* (2013.01); *A43B 13/188* (2013.01); *A43B 13/206* (2013.01); *A43B 17/035* (2013.01)

(58) Field of Classification Search

None

See application file for complete search history.

(56) References Cited

U.S. PATENT DOCUMENTS

| | | | |
|---|---|---|---|
| 4,358,902 | A | 11/1982 | Cole et al. |
| 5,353,525 | A | 10/1994 | Grim |
| 5,673,500 | A | 10/1997 | Huang |

(Continued)

FOREIGN PATENT DOCUMENTS

| | | | |
|---|---|---|---|
| CN | 103783723 | A | 5/2014 |
| CN | 107152391 | A | 9/2017 |

(Continued)

OTHER PUBLICATIONS

Sep. 10, 2019—(WO) ISR & WO—App. No. PCT/US19/034274.

*Primary Examiner* — Jila M Mohandesi

(74) *Attorney, Agent, or Firm* — Banner & Witcoff, Ltd.

(57) ABSTRACT

Foot support systems, e.g., for articles of footwear, include systems for changing the hardness or firmness of the foot support portion (e.g., of a sole structure) and/or systems for moving (e.g., selectively moving) fluid between various portions of the foot support system. Such systems may include: a foot support bladder, a pump, and a fluid reservoir. Two or more fluid transfer lines may be provided to connect these components, and these fluid lines are equipped with fluid flow control device(s) and/or check valves to enable selective movement of fluid between the fluid reservoir and the foot support bladder. Such systems enable one to set and maintain two or more foot support pressures in the foot support bladder.

20 Claims, 23 Drawing Sheets

(56) References Cited

U.S. PATENT DOCUMENTS

| | | | | |
|---|---|---|---|---|
| 5,813,142 | A | 9/1998 | Demon | |
| 6,014,823 | A | 1/2000 | Lakic | |
| 6,430,843 | B1 | 8/2002 | Potter et al. | |
| 6,519,873 | B1 | 2/2003 | Buttigieg | |
| 6,571,490 | B2 | 6/2003 | Tawney et al. | |
| 6,589,194 | B1 | 7/2003 | Calderon et al. | |
| 6,892,477 | B2 * | 5/2005 | Potter | A43B 3/44 36/35 B |
| 7,013,585 | B2 * | 3/2006 | Lo | A43B 13/203 36/29 |
| 7,278,445 | B2 | 10/2007 | Marvin et al. | |
| 7,331,121 | B2 | 2/2008 | Lo | |
| 7,395,614 | B1 | 7/2008 | Bailey, Sr. et al. | |
| 7,448,150 | B1 | 11/2008 | Davis et al. | |
| 7,478,488 | B1 | 1/2009 | Davis et al. | |
| 7,694,438 | B1 | 4/2010 | Christensen et al. | |
| 8,914,994 | B2 | 12/2014 | James | |
| 9,066,558 | B2 | 6/2015 | Molyneux et al. | |
| 11,039,661 | B2 * | 6/2021 | Weast | A43B 13/206 |
| 11,206,896 | B2 * | 12/2021 | Henrichot | A43B 3/38 |
| 11,234,485 | B2 * | 2/2022 | Henrichot | A43B 13/203 |
| 11,793,272 | B2 * | 10/2023 | Molyneux | A43B 13/20 |
| 11,889,890 | B2 * | 2/2024 | Weast | A43B 13/203 |
| 11,969,053 | B2 * | 4/2024 | Henrichot | A43B 13/203 |
| 11,986,053 | B2 * | 5/2024 | Henrichot | A43B 3/38 |
| 2002/0035794 | A1 | 3/2002 | Doyle | |
| 2004/0003515 | A1 | 1/2004 | Marvin et al. | |
| 2005/0027221 | A1 | 2/2005 | Calderon et al. | |
| 2005/0132617 | A1 | 6/2005 | Potter et al. | |
| 2006/0196081 | A1 * | 9/2006 | Lee | A43B 13/206 36/29 |
| 2007/0084082 | A1 | 4/2007 | Dojan et al. | |
| 2010/0063778 | A1 | 3/2010 | Schrock et al. | |
| 2011/0131839 | A1 | 6/2011 | Ballin et al. | |
| 2011/0138654 | A1 | 6/2011 | Cook et al. | |
| 2012/0084998 | A1 | 4/2012 | Biesse | |
| 2012/0291564 | A1 | 11/2012 | Amos et al. | |
| 2013/0192087 | A1 | 8/2013 | Litchfield et al. | |
| 2013/0326912 | A1 | 12/2013 | Lindsay et al. | |
| 2014/0215849 | A1 | 8/2014 | Litchfield et al. | |
| 2015/0208761 | A1 | 7/2015 | Almeida et al. | |
| 2016/0331075 | A1 | 11/2016 | Cook et al. | |
| 2017/0071287 | A1 | 3/2017 | Kim | |
| 2017/0295885 | A1 | 10/2017 | Stern | |
| 2022/0079289 | A1 | 3/2022 | Henrichot et al. | |

FOREIGN PATENT DOCUMENTS

| | | | |
|---|---|---|---|
| CN | 110430777 | A | 11/2019 |
| DE | 102015225209 | A1 | 6/2017 |
| GB | 2114425 | A | 8/1983 |
| TW | M547865 | U | 9/2017 |
| TW | M551000 | U | 11/2017 |
| WO | 9118527 | A1 | 12/1991 |
| WO | 2012136842 | A1 | 10/2012 |
| WO | 2017101902 | A1 | 6/2017 |
| WO | 2018157039 | A1 | 8/2018 |

* cited by examiner

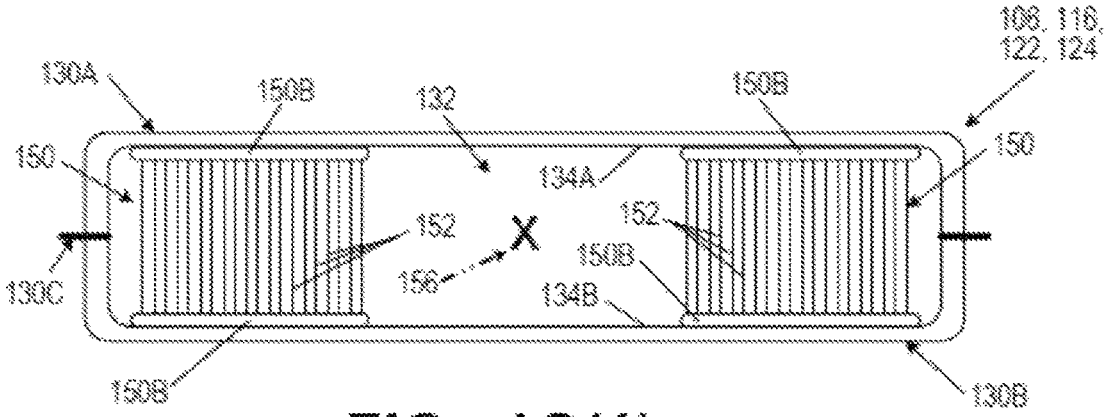
FIG. 1G(1)
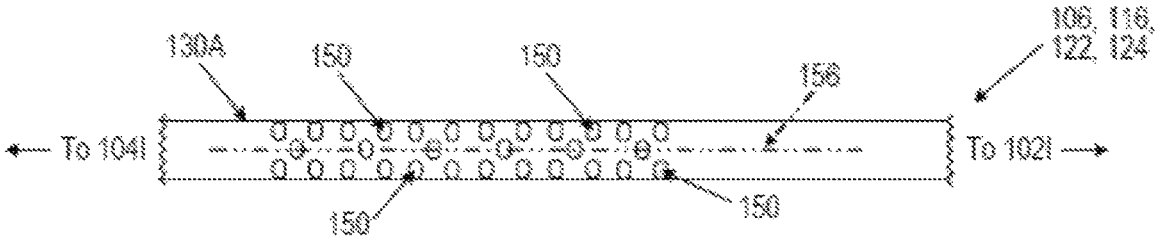
FIG. 1G(2)
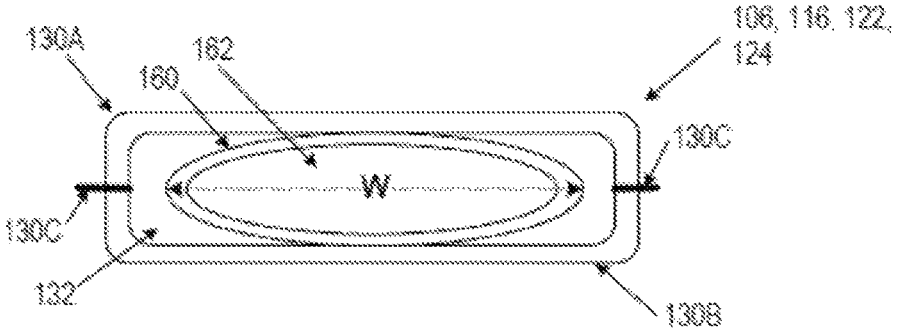
FIG. 1H(1)
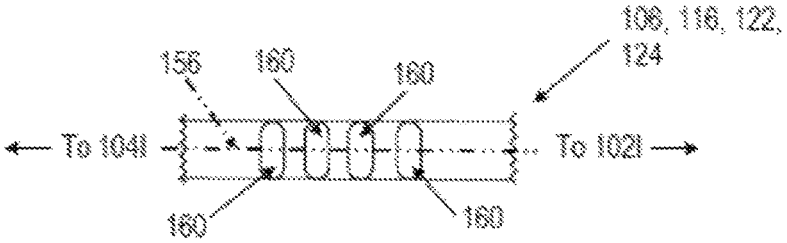
FIG. 1H(2)

ADJUSTABLE FOOT SUPPORT SYSTEMS INCLUDING FLUID-FILLED BLADDER CHAMBERS

RELATED APPLICATION DATA

This application is a: (a) continuation of co-pending U.S. patent application Ser. No. 17/316,400, filed May 10, 2021, which is (b) a divisional application of U.S. patent application Ser. No. 16/425,356 filed May 29, 2019 (now U.S. Pat. No. 11,039,661 B2 granted Jun. 22, 2021), which claims priority benefits based on (c) U.S. Provisional Patent Appln. No. 62/678,662 filed May 31, 2018. U.S. Provisional Patent Appln. No. 62/678,662 and U.S. patent application Ser. Nos. 16/425,356 and 17/316,400 are entirely incorporated herein by reference. Also, aspects and features of this invention may be used in conjunction with the systems and methods as described in U.S. Provisional Patent Appln. No. 62/463,859 filed Feb. 27, 2017 and U.S. Provisional Patent Appln. No. 62/463,892 filed Feb. 27, 2017. Each of U.S. Provisional Patent Appln. No. 62/463,859 and U.S. Provisional Patent Appln. No. 62/463,892 is entirely incorporated herein by reference.

FIELD OF THE INVENTION

The present invention relates to foot support systems in the field of footwear or other foot-receiving devices. More specifically, aspects of the present invention pertain to foot support systems, e.g., for articles of footwear, that include systems for changing the hardness or firmness of the foot support portion and/or systems for selectively moving fluid between various portions of the foot support system, foot-receiving device, and/or article of footwear.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, etc.), and the like. "Foot-receiving device," as that term is used herein, means any device into which a user places at least some portion of his or her foot. In addition to all types of "footwear," foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures, and one or more "foot-supporting members" (e.g., akin to footwear sole structure components), which support at least some portion(s) of a plantar surface of a user's foot. "Foot-supporting members" may include components for and/or functioning as midsoles and/or outsoles for articles of footwear (or components providing corresponding functions in non-footwear type foot-receiving devices).

SUMMARY OF THE INVENTION

This Summary is provided to introduce some general concepts relating to this invention in a simplified form that are further described below in the Detailed Description. This Summary is not intended to identify key features or essential features of the invention.

Aspects of this invention relate to foot support systems, articles of footwear, and/or other foot-receiving devices, e.g., of the types described and/or claimed below and/or of the types illustrated in the appended drawings. Such foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

While aspects of the invention are described in terms of foot support systems, additional aspects of this invention relate to articles of footwear, methods of making such foot support systems and/or articles of footwear, and/or methods of using such foot support systems and/or articles of footwear.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

FIGS. 1A-1H(2) illustrate various features of foot support structures, components thereof, and/or articles of footwear in accordance with some examples and aspects of this invention;

DETAILED DESCRIPTION OF THE INVENTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made to the specifically described structures and methods without departing from the scope of the present invention.

I. GENERAL DESCRIPTION OF ASPECTS OF THIS INVENTION

As noted above, aspects of this invention relate to foot support systems, articles of footwear, and/or other foot-receiving devices, e.g., of the types described and/or claimed below and/or of the types illustrated in the appended drawings. Such foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

Given the general description of features, aspects, structures, processes, and arrangements according to certain embodiments of the invention provided above, a more detailed description of specific example foot support structures, articles of footwear, and methods in accordance with this invention follows.

II. DETAILED DESCRIPTION OF EXAMPLE FOOT SUPPORT SYSTEMS AND OTHER COMPONENTS/FEATURES ACCORDING TO THIS INVENTION

Figure 1A:
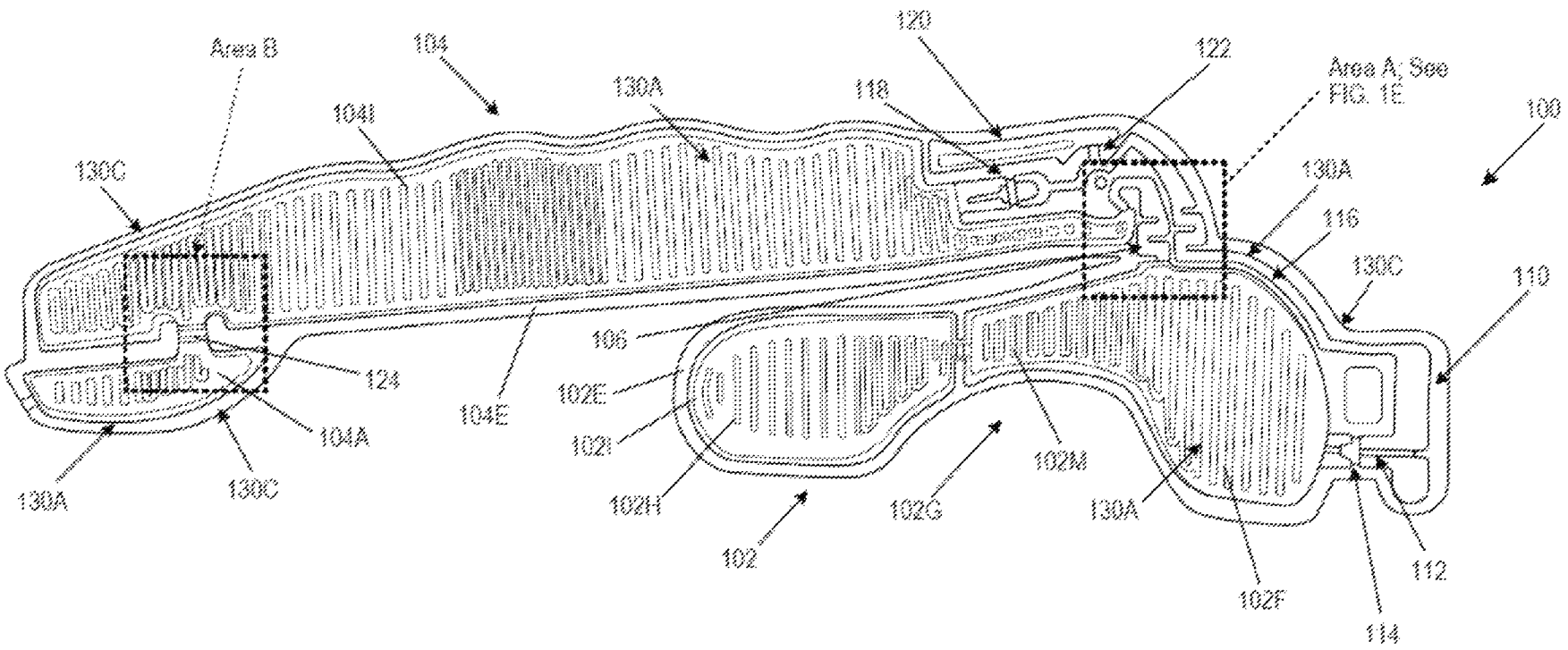
Figure 1B:
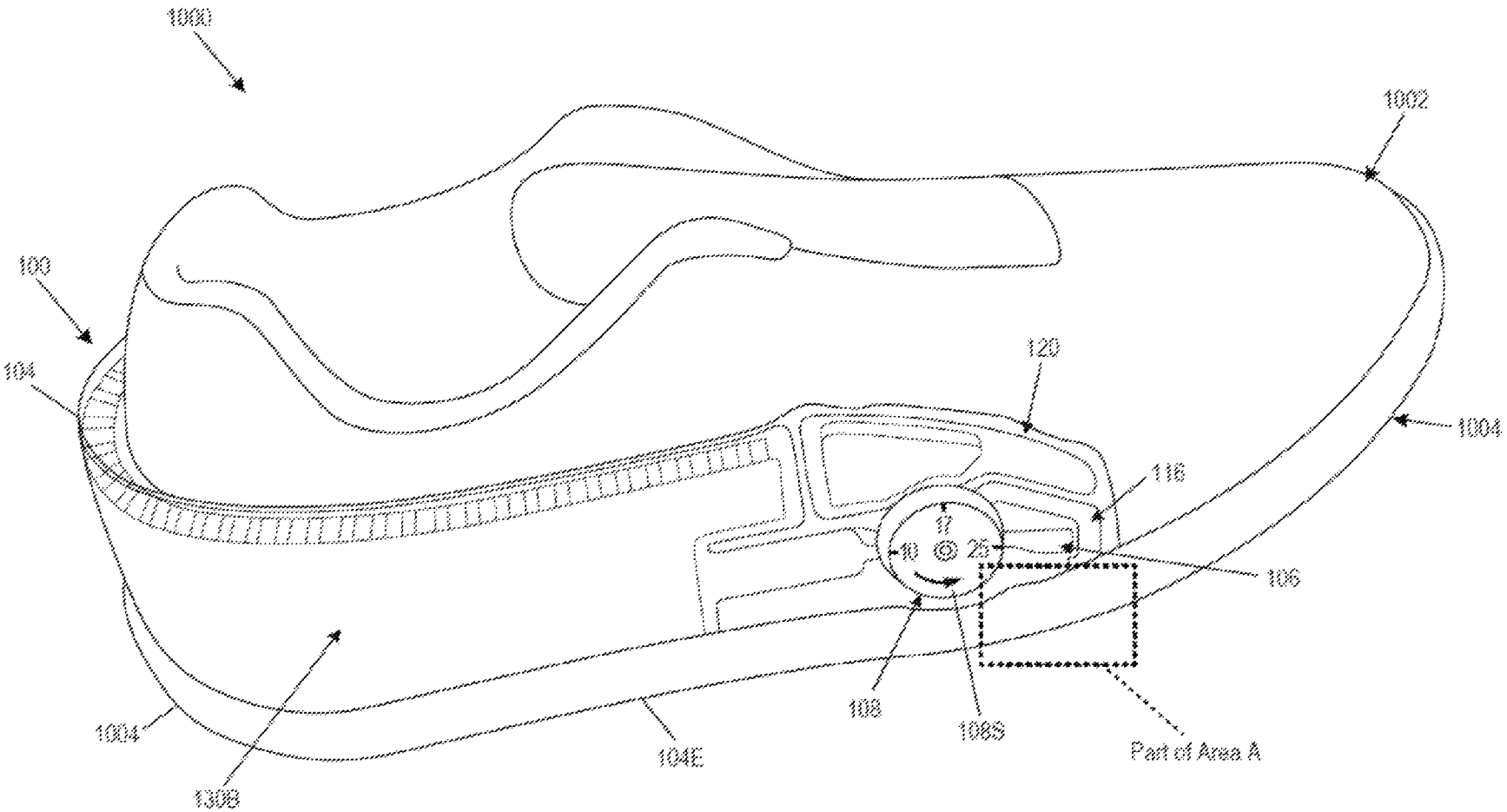
Figure 1C:
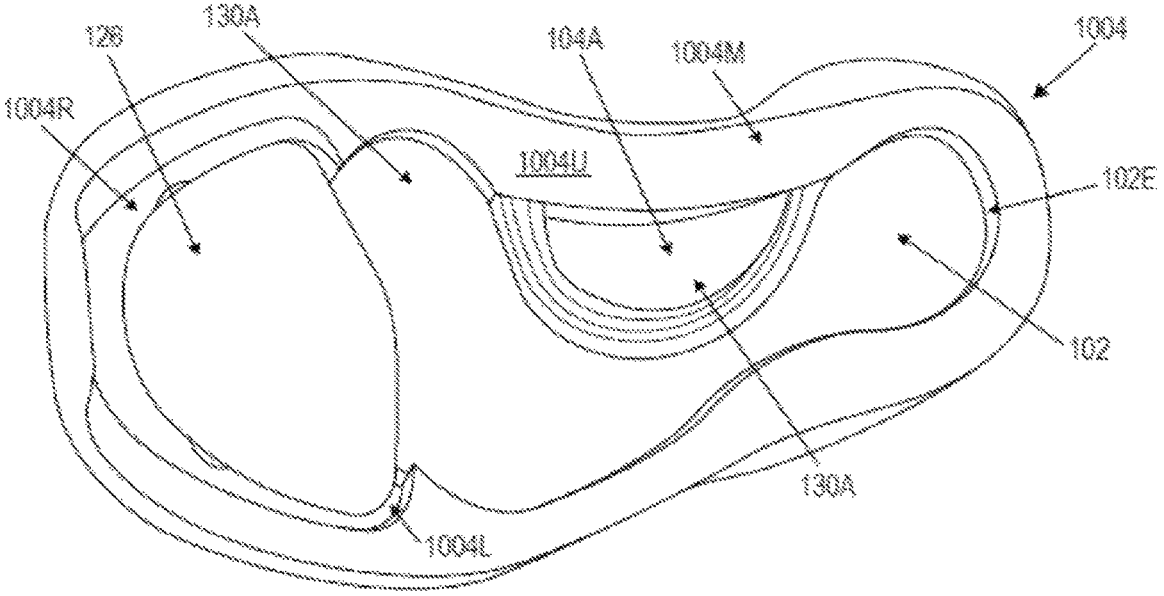
Figure 1D:
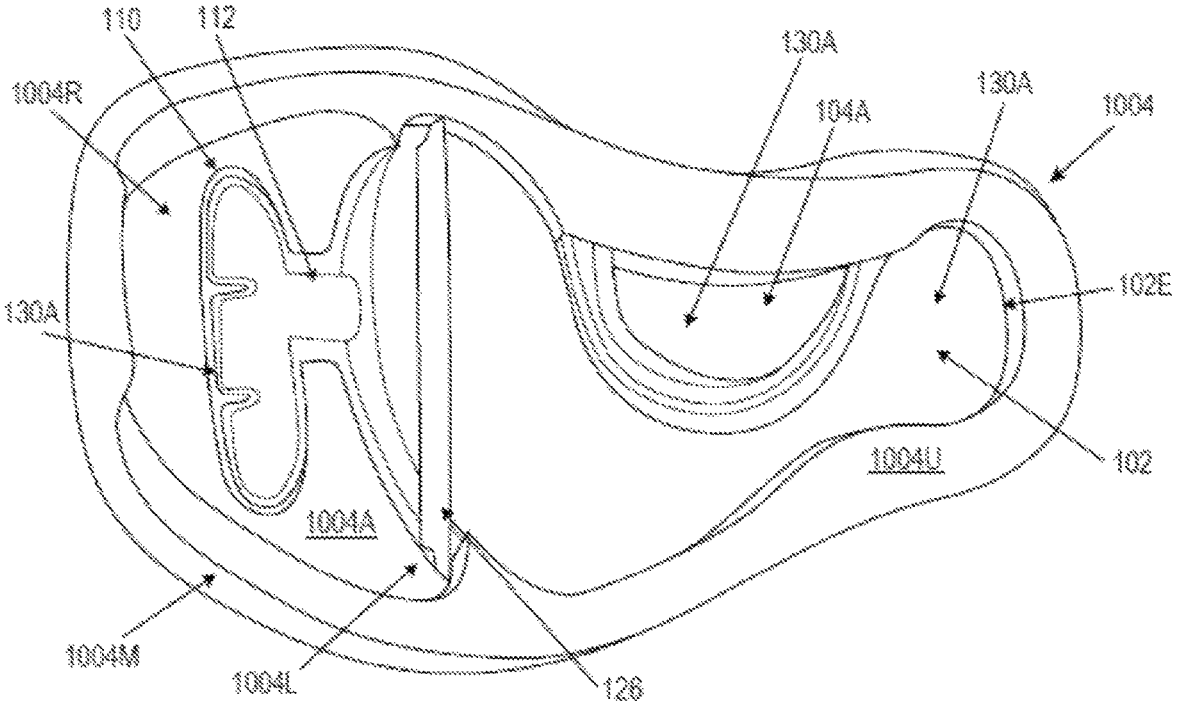
Figure 1E:
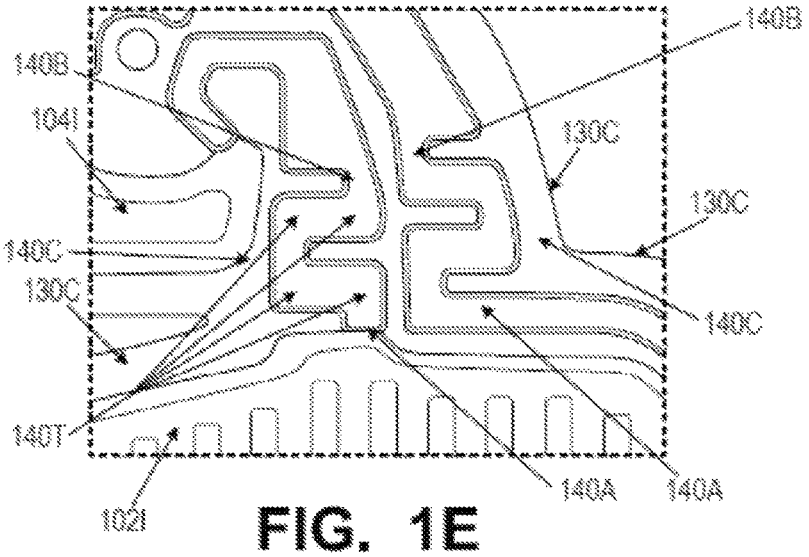

Referring to the figures and following discussion, various examples of foot support systems in accordance with aspects of this invention are described. FIG. 1A shows a first example foot support system 100 in accordance with some aspects of this invention; FIG. 1B shows this foot support system 100 incorporated into an article of footwear 1000; FIGS. 1C and 1D provide views of a portion of a foot support system 100 in a sole structure 1004 of an article of footwear 1000 (with the fluid reservoir bladder 104 omitted in these figures to provide a clearer view of the sole structure 1004); FIG. 1E provides a close up view of the area shown in FIG. 1A; and FIGS. 1F-1H(2) provide views illustrating various anti-pinch structures for fluid flow lines that may be used in at least some examples of this invention.

Foot support systems 100 in accordance with at least some aspects of this invention may be fluid-tight (e.g., sealed with enclosed gas), and optionally a closed system (e.g., a system that does not intake/receive fluid (e.g., gas) from an external source (such as the ambient atmosphere) and/or does not release fluid (e.g., gas) to the external environment). A foot support bladder 102 (including its interior chamber 102I) is provided. While various sizes and/or shapes are possible, at least some foot support bladders 102 of this type will be sized and shaped so as to support a majority of a plantar surface of a user's foot (e.g., providing at least a heel support portion 102H and a forefoot support portion 102F; extending continuously to provide a heel support portion 102H, a midfoot support portion 102M, and a forefoot support portion 102F; and/or extending from a lateral side edge to a medial side edge, in one or more of these support portions 102H, 102M, and/or 102F; etc.). As some additional options, foot support bladders 102 of this type may support at least 60%, at least 70%, at least 80%, at least 90%, or even up to 100% of the plantar surface of the user's foot.

This example foot support system 100 further includes a fluid reservoir bladder 104 (including its interior chamber 104I). A first fluid transfer line 106 interconnects the interior chamber 102I of foot support bladder 102 with the interior chamber 104I of fluid reservoir bladder 104 and places these bladders (and their interior chambers) in fluid communication with one another. In this illustrated example, this first fluid transfer line 106 is the only direct fluid connection between the foot support bladder 102 interior chamber 102I and the fluid reservoir bladder 104 interior chamber 104I. A fluid flow control system 108 (e.g., a valve, a tube "pinch-off" structure, etc., see FIG. 1B) may be provided to selectively change the first fluid transfer line 106 between: (a) an open condition (in which fluid flow between the interior chamber 102I of the foot support bladder 102 and the interior chamber 104I of the reservoir bladder 104 occurs) and (b) a closed condition (in which fluid flow between the interior chamber 102I of the foot support bladder 102 and the interior chamber 104I of the fluid reservoir bladder 104 is stopped).

FIGS. 1A and 1D further illustrate a pump 110 that may be provided in foot support systems 100 in accordance with at least some aspects of the invention. Any desired type of pump 110 can be used without departing from this invention, including a reversing pump, a foot-activated pump, and bulb pump, etc. The pump 110 may be disposed at a location so as to be activated by a user's foot, e.g., at a heel area or a forefoot area of a footwear sole structure 1004, such that when the user steps (e.g., lands on his/her heel, toes off, etc.), the pump 110 is activated to push out fluid from its chamber. Further, as shown in FIGS. 1A and 1D, a fluid transfer line 112 may be provided extending between the foot support bladder 102 interior chamber 102I and the pump 110 interior chamber to enable transfer of fluid from the foot support bladder 102 to the pump 110. A valve 114 (e.g., a one-way valve of any desired design or construction) may be provided, e.g., within fluid transfer line 112, at the inlet to fluid transfer line 112, at the outlet of fluid transfer line 112, etc., to allow fluid transmission from the foot support bladder 102 into the pump 110 via fluid transfer line 112 but not allowing fluid transmission from the pump 110 into the foot support bladder 102 via fluid transfer line 112.

Another fluid transfer line 116 may be provided extending between the pump 110 and the fluid reservoir bladder 104 (and allowing fluid to flow from the pump 110 to the fluid reservoir bladder 104 interior chamber 104I). Another valve 118 (e.g., a one-way valve of any desired design or construction) may be provided, e.g., within fluid transfer line 116, at the inlet to fluid transfer line 116, at the outlet of fluid transfer line 116, etc., to allow fluid transmission from the pump 110 into the fluid reservoir bladder 104 via fluid transfer line 116 but not allowing fluid transmission from the fluid reservoir 104 into the pump 110 via fluid transfer line 116.

At least some example foot support systems 100 in accordance with this aspect of the invention will further include a reserve reservoir 120 in the system 100. When present, this reserve reservoir 120 may be connected to at least one of the pump 110, the fluid reservoir bladder 104, and/or the fluid transfer line 116 between the pump 110 and the fluid reservoir bladder 104 (e.g., by fluid transfer line 122). Reserve reservoir 120 in this illustrated example is connected to fluid transfer line 116 between the pump 110 and the fluid reservoir 104 via fluid transfer line 122. A fluid flow control system 108 (e.g., a valve, a tube "pinch-off" structure, etc., see FIG. 1B) may be provided for changing fluid transfer line 122 between: (a) an open condition (in which fluid transfers between the reserve reservoir 120 and at least one of the pump 110, the fluid reservoir 104, or fluid transfer line 116) and (b) a closed condition (in which fluid does not transfer between the reserve reservoir 120 and any of the pump 110, the fluid reservoir bladder 104, or fluid transfer line 116). The fluid flow control system 108 for controlling fluid transfer to/from reserve reservoir 120 may be part of the same fluid control system 108 or structure for controlling fluid transfer between fluid reservoir bladder 104 and foot support bladder 102 or it may be a different system or structure. In at least some examples of this invention, the reserve reservoir 120 will have a total volume of less than 25% of a total volume of the fluid reservoir 104, and in some examples, a total volume of less than 20%, less than 15%, less than 10%, less than 5%, or even less than 2.5% of a total volume of the fluid reservoir 104. Additionally or alternatively, in at least some examples of this invention, the reserve reservoir 120 will have a total volume of less than 25% of a total volume of the foot support bladder 102, and in some examples, a total volume of less than 20%, less than 15%, less than 10%, less than 5%, or even less than 2.5% of a total volume of the foot support bladder 102.

Example operation of the various components of foot support system 100 for changing foot support hardness/firmness and/or changing pressure/moving fluid in the system 100 will be described in more detail below, e.g., in conjunction with FIGS. 3A-4C, after the more detailed description of various example structures and features of this invention provided below.

FIGS. 1B-1D illustrate the foot support system 100 incorporated into an article of footwear 1000 (although reference number 1000 may represent any type of foot-receiving device). The article of footwear 1000 of this example includes an upper 1002 and a sole structure 1004 engaged with the upper 1002. The footwear upper 1002 may have any desired construction, may be made of any desired materials, and/or may have any desired number of component parts without departing from this invention, including constructions, materials, and/or component parts as are conventionally known and used in the footwear arts. In final assembly, the fluid reservoir bladder 104 is moved or is bent with respect to foot support bladder 102 (from the configuration shown in FIG. 1A) along fluid transfer lines 106 and 116, is formed into a curved shape (e.g., a U-shape) around a heel area of the footwear 1000, and is engaged with (or integrally forms a part of) footwear upper 1002 and/or sole structure 1004, e.g., as shown in FIG. 1B. In this manner, the fluid reservoir bladder 104 is moved such that its bottom perimeter edge 104E extends adjacent and around a portion of the perimeter edge 102E of the foot support bladder 102 (e.g., around the rear heel area of the upper 1002 at least to the lateral heel area and/or the medial heel area of the upper 1002, and optionally to the lateral midfoot area or the lateral forefoot area of the upper 1002 and/or optionally to the medial midfoot area or medial forefoot area of the upper 1002. While FIG. 1B shows fluid reservoir bladder 104 forming a portion of the outer surface of the upper 1002, this is not a requirement. Additionally or alternatively, if desired, the fluid reservoir bladder 104 may be at least partially provided in an interior foot-receiving chamber of the footwear 1000, between layers of the upper 1002, along a vamp area of the upper 1002 (inside, outside, or between layers of the vamp), in a footwear tongue structure, and/or at any other desired portion of the upper 1002.

FIG. 1A further illustrates that the fluid reservoir bladder 104 of this illustrated example includes an arch support portion 104A formed therein. The arch support portion 104A is in fluid communication with interior chamber 104I of the fluid reservoir bladder 104 via fluid transfer line 124. In final assembly, the fluid reservoir bladder 104 folds/bends along fluid transfer line 124 and the arch support portion 104A fits into the arch gap 102G provided in this example foot support bladder 102. In this manner, the fluid reservoir bladder 104 also may provide at least a portion of an overall foot support function (and a portion of plantar support surface) of the foot support system 100. See also FIGS. 1C and 1D. In this illustrated example, the arch support portion 104A "nests" within an area or volume defined by the foot support bladder 102 (e.g., within arch gap 102G). The terms "nest," "nests," or "nested" as used herein in this context, means that one bladder at least partially surrounds at least a portion of a perimeter of another bladder (e.g., one bladder surrounds 50% or more of an outer side perimeter or outer side wall/surface of another bladder) and/or that the two bladder portions otherwise have complementary shaped surfaces (e.g., at least side surfaces or walls) that tightly or compactly fit together. While the nested bladder may have at least some portions of its side wall(s)/surface(s) "surrounded" by the other bladder, a nested bladder also could have some portions of its top and/or bottom major surfaces "surrounded" by the other bladder.

At least the foot support bladder 102 of this example foot support system 100 may be mounted in or on a footwear sole structure 1004, as shown in FIGS. 1C and 1D. The footwear sole structure 1004 may constitute a midsole 1004M (e.g., made from one or more polymeric foam material parts), an outsole component, and/or both. The footwear sole structure 1004 may have any desired construction, may be made of any desired materials, and may have any desired number of component parts without departing from this invention, including constructions, materials, and/or component parts as are conventionally known and used in the footwear arts. In this illustrated example, the sole structure 1004 includes a recess 1004R formed in its upper surface 1004U, and at least some portion of the foot support bladder 102 is received within the recess 1004R (and optionally engaged with the sole structure 1004 within this recess 1004R, such as with the bottom interior surface 1004A of sole structure 1004). While not shown in the example of FIGS. 1C and 1D, the upper surface 1004U of the sole member 1004 and the top surface of foot support bladder 102 may be covered, e.g., by a strobel member, by a fabric sheet, by a bottom surface of the upper 1002 by a thin polymeric foam layer, and/or other desired component. Alternatively, if desired, the user's foot (e.g., in a sock) may directly contact one or more of the structures shown in FIGS. 1C and 1D (e.g., at least some of the features shown in FIGS. 1C and 1D may form the bottom interior foot-receiving chamber of the shoe 1000).

FIGS. 1C and 1D further show that this example foot support system 100 includes a pump activator 126, which is formed as a plate in this structure. The pump activator 126 may be mounted to sole structure 1004 (e.g., by a hinge, on a support surface or ledge 1004L of sole structure 1004, etc.). The pump activator 126 moves downward to compress the pump 110 bulb, e.g., under the force of a wearer's foot on a "toe off" phase of a step cycle or jump, to potentially move fluid in the foot support system 100, as will be described in more detail below. While the pump 110 and pump activator 126 are shown in the forefoot/toe area of this example sole structure 1004, they may be provided in other areas without departing from this invention, such as in the heel area (for activation when landing a step or jump, etc.).

In at least some examples of this invention, two or more of the foot support bladder 102, the fluid reservoir bladder 104, the arch support bladder portion 104A, the pump 110, the reserve reservoir 120, the fluid transfer line 106, the fluid transfer line 112, the fluid transfer line 116, the fluid transfer line 122, and/or the fluid transfer line 124 may be made as a unitary, one piece construction. More specifically, any desired two or more of these parts (and optionally all of the parts) may be formed from two thermoplastic elastomer sheet members (which may constitute a single thermoplastic elastomer sheet that is folded) that are sealed together, e.g., by adhesives, by welding techniques (e.g., RF welding, ultrasonic welding, thermal welding, etc.), etc. Note, for example, sheets 130A and 130B shown in FIGS. 1G(1) and 1H(1). The sheets 130A and 130B are joined at seal lines 130C (or weld joints), e.g., around their outer perimeter edges and other seal locations (e.g., at locations other than locations where fluid flow is desired). The bladder structure (s), their constructions, materials, and manufacturing methods may be conventional as are known and used in the footwear arts. The bladder structure(s) also may include internal tensile components, e.g., to control the bladder shape (e.g., to provide relatively smooth and/or contoured surfaces), as also are known and used in the footwear arts.

Thermoplastic materials of the types used in fluid-filled bladders for articles of footwear may be relatively flexible and pliable. But, as noted above, in at least some examples of this invention, one or more of the fluid transfer lines (which may be integrally formed as part of the overall bladder/foot support system 100 structure), e.g., lines 106, 116, and/or 124, may be "bent", folded, or flexed to allow desired positioning of the fluid reservoir bladder 104 portions with respect to one another and/or with respect to the foot support bladder 102 in the final foot support system 100 structure. Such bends are described above, for example in conjunction with Area A shown in FIGS. 1A and 1E and Area B shown in FIG. 1A. If necessary or desired, in accordance with at least some examples of this invention, structure and/or components may be provided to prevent undesired closure (e.g., pinch-off, kink, etc.) of these relatively small and thin fluid transfer lines at the bend/fold locations.

Figure 1F:
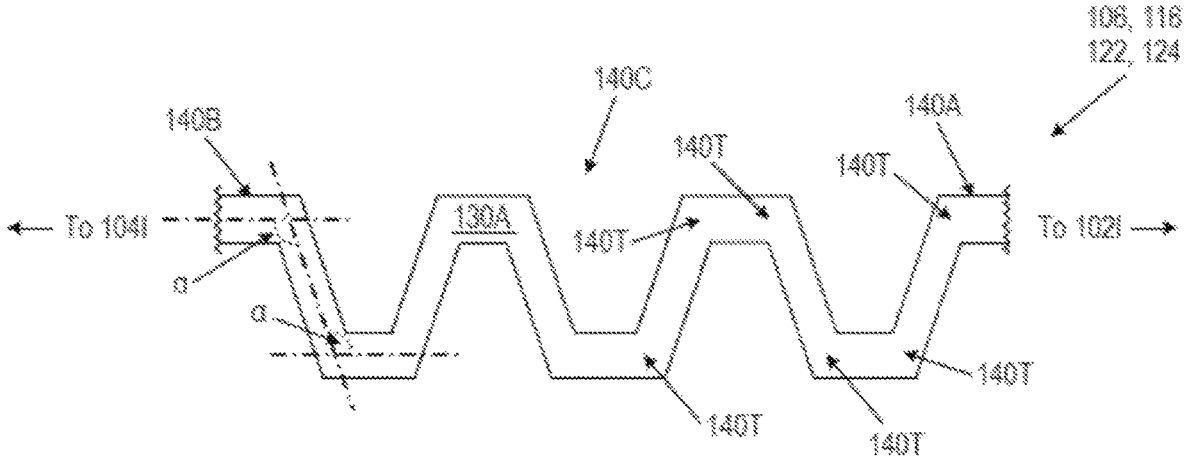

FIGS. 1A and 1E-1H(2) illustrate examples of structures/components that may be provided to help prevent undesired closure (e.g., pinch-off, kink, etc.) of various areas of the overall bladder system 100, e.g., such as at the relatively small and thin fluid transfer lines 106, 116, and/or 124 at the bend/flex locations. As one example, as shown in FIGS. 1E and 1F, a fluid transfer line connecting interior chambers of two bladders (e.g., connecting bladders 102/104, bladders 104/104A, pump chamber 110 and bladder 104/120, etc.) may include a first segment 140A in fluid communication with one interior chamber (e.g., chamber 102I), a second segment 140B in fluid communication with another interior chamber (e.g., chamber 104I), and a non-linear connecting portion 140C placing the first segment 104A and the second segment 104B in fluid communication with one another. In some more specific examples, as shown in FIG. 1E, the non-linear connecting portion 140C may include a U-shaped tube extending from the first segment 140A to the second segment 140B. As some other options and/or examples, the non-linear connecting portion 140C may define at least four turns 140T between the first segment 140A and the second segment 140B, wherein at least two turns 140T of the at least four turns 140T (and optionally at least four turns and/or all turns) define an angle $\alpha$ between 60° and 120°. Note FIG. 1F (which shows a top down view similar to FIG. 1E of another example fluid transfer line and connection portion 140C structure). In this manner, if desired, the non-linear connecting portion 140C may define a "zig-zag" or "herringbone" shape. This non-linear shape can help prevent undesired closure or "pinch-off" of the interior channel of fluid transfer line. Optionally, these shaping features may be used in conjunction with one or more of the features described below in conjunction with FIGS. 1G(1)-1H(2).

FIGS. 1G(1) and 1G(2) show another example structure to help prevent undesired closure (e.g., pinch-off, kink, etc.) of various areas of the overall bladder system 100, e.g., at the bend/flex locations, in the fluid transfer lines, etc. In the example of FIGS. 1G(1) and 1G(2), one or more tensile elements 150 are provided within the enclosed flow channel defined by the fluid transfer/flow line 106, 116, 122, 124. The tensile member(s) 150 is/are provided inside an interior volume 132 defined by the bladder exterior envelope sheets 130A/130B. In this illustrated example, the tensile member (s) 150 include bases 150B attached to the interior surfaces 134A/134B of sheets 130A/130B (e.g., by welding, adhesives, etc.), and the bases 150B are interconnected by a plurality of fibers or strands 152. The fibers or strands 152 help maintain the bladder structures in the desired shape by limiting separation of the envelope sheets 130A/130B when the bladder is inflated. The bases 150B and fibers or strands 152 also tend to interact with one another and the interior surfaces 134A/134B to prevent complete "pinching," "kinking," or other undesired closure of the interior volume 132, e.g., when the fluid transfer/flow line 106, 116, 122, 124 is bent, folded, or rotated in a direction perpendicular to its longitudinal axis 156 (the longitudinal axis 156 is shown into and out of the page of FIG. 1G(1) by the central "X" labeled 156). In this manner, the bases 150B and/or fibers/strands 152 provide a continuous path for fluid to flow through fluid transfer/flow line 106, 116, 122, 124 through the bent or rotated area (e.g., like the areas A and B shown in FIG. 1A). The top view of FIG. 1G(2) shows that multiple tensile members 150 may be provided along the longitudinal direction.

Another example fluid-flow support component provided within an enclosed flow channel 132 of a fluid transfer/flow line (e.g., 106, 116, 122, 124) to prevent undesired complete closure of the fluid transfer/flow line is shown in FIGS. 1H(1) and 1H(2). In this illustrated example, one or more interior tubular components 160 are provided within the interior chamber 132 defined by thermoplastic sheets 130A/130B. The tubular component(s) 160 has/have a through hole 162 defined through it/them and may be made from a rigid plastic material. The tubular component(s) may have a shorter axial dimension (along axis 156 into and out of the page of FIG. 1H(1)) than side-to-side width dimension W. In such structures, when the fluid transfer/flow line 106, 116, 122, 124 is bent or rotated in a direction perpendicular to its longitudinal axis 156, the through hole(s) 162 of tubular component(s) 160 still provide a continuous path for fluid to flow through fluid transfer/flow line 106, 116, 122, 124 through the bent or rotated area (e.g., like the areas A and B shown in FIG. 1A) and thereby prevent complete kinking or pinching off of the fluid transfer/flow line 106, 116, 122, 124. The top view of FIG. 1H(2) shows that multiple tubular components 160 may be provided along the tubular member longitudinal or axial direction 156.

In at least some examples of this invention, the fluid transfer/flow lines 106, 116, 122, 124 may have a relatively small cross sectional area or volume, e.g., as compared to volumes of interior chambers 102I and 104I. As some more specific examples, any one or more of the fluid transfer/flow lines 106, 116, 122, 124 (between the interior chambers 102I/104I of foot support bladder 102 and fluid reservoir bladder 104, between pump chamber 110 and fluid reservoir bladder 104, between fluid transfer line 116 and reserve reservoir 120, between fluid reservoir bladder 104 and the arch support portion 104A thereof, etc.) may have an internal cross sectional area transverse to a fluid flow direction over at least a majority of its axial length (e.g., the areas shown by the views of FIGS. 1G(1) and 1H(1)) of less than 10 $cm^2$, and in some examples, less than 6 $cm^2$, less than 4 $cm^2$, or even less than 2.5 $cm^2$. As yet additional or alternative potential features, any one or more of the fluid transfer/flow lines 106, 116, 122, 124 may have an internal volume between the bladder chambers that it connects (or between a bladder chamber and a valve structure in the fluid transfer line) of less than 20 $cm^3$, and in some examples, less than 16 $cm^3$, less than 10 $cm^3$, less than 8 $cm^3$, or even less than 6 $cm^3$.

Figure 2A:
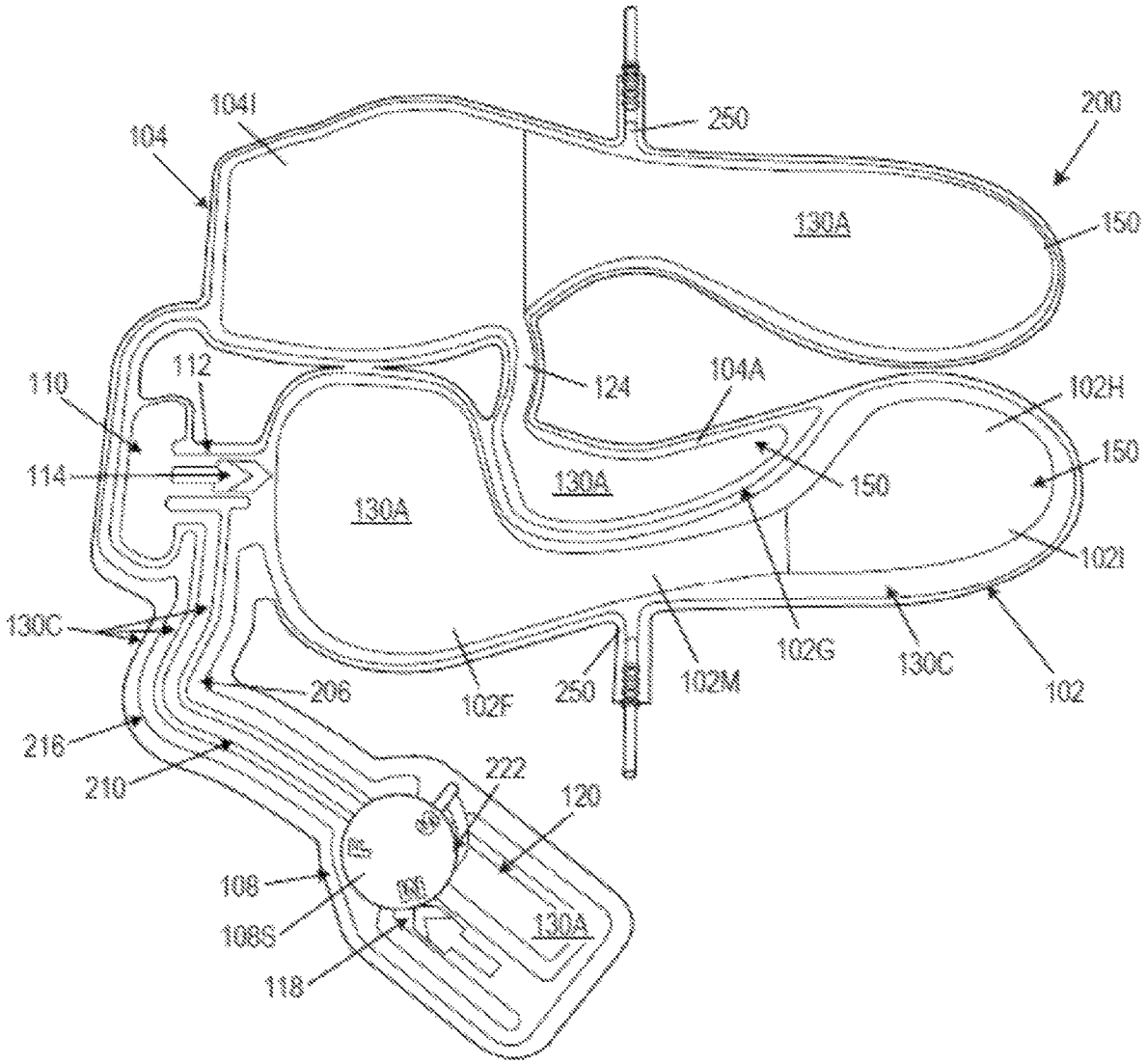
FIGS. 2A-2F illustrate various features of foot support structures, components thereof, and/or articles of footwear in accordance with additional examples and aspects of this invention.
Figure 2B:
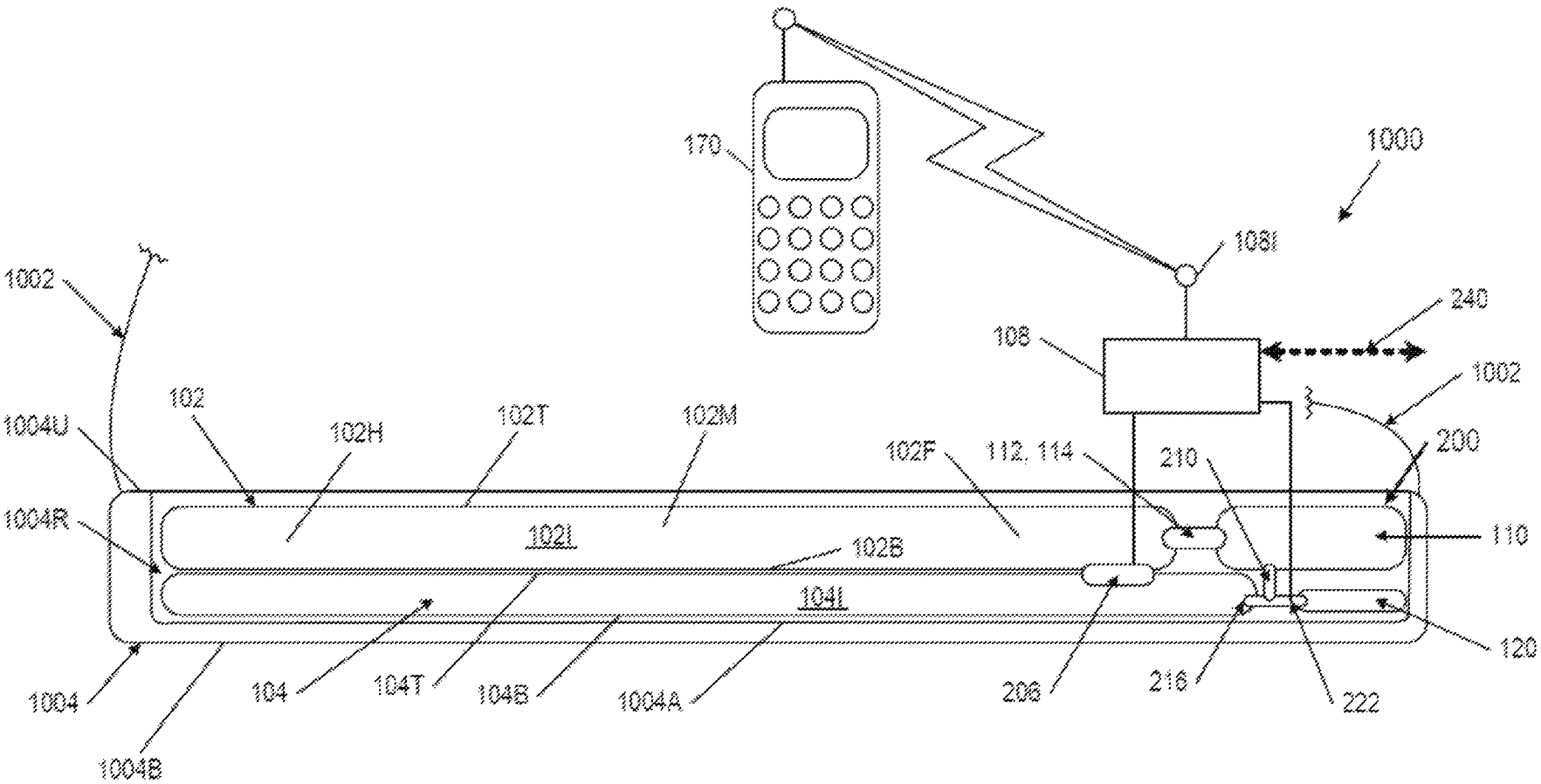

FIGS. 2A-2D illustrate another example of a foot support system 200 in accordance with some examples and aspects of this invention. Where the example system 200 of FIGS. 2A and 2B includes the same or similar parts as those in the system 100 of FIGS. 1A-1H(2), the same reference numbers are used, and a detailed corresponding and repetitive description of these same or similar parts will be omitted. One difference between the foot support system 200 of FIGS. 2A and 2B and that shown in FIGS. 1A-1H(2) relates to positioning of the fluid reservoir bladder 104 in the final footwear/foot-receiving device assembly. While FIGS. 1A-1H(2) show systems 100 in which at least a majority of the fluid reservoir bladder 104 is located around and/or as part of the footwear upper 1002, in the example system 200 of FIGS. 2A and 2B, the fluid reservoir bladder 104 is folded around to a location beneath the foot support bladder 102 and within sole structure 1004, as shown in FIG. 2B. In this manner, in the final footwear structure 1000, the fluid reservoir bladder 104 is folded/vertically stacked beneath the foot support bladder 102 such that the top major surface 104T of fluid reservoir bladder 104 when the bladder 104 is formed will directly face (and optionally directly contact) the bottom major surface 102B of the foot support bladder 102 (and the bottom major surface 104B of fluid reservoir bladder 104 when the bladder 104 is formed will face away from the top major surface 102T of the foot support bladder 102 in the final footwear 1000 assembly). Also, as shown in FIG. 2A, in this illustrated example, an arch support portion 104A of the fluid reservoir bladder 104 "nests" within an area or volume defined by the foot support bladder 102 (e.g., within arch gap 102G).

Like the system 100 of FIGS. 1A-1H(2), this example foot support system 200 is formed to include fluid transfer lines as integral parts of the overall bladder construction. For example, FIG. 2A illustrates fluid transfer line 112 for moving fluid from the foot support bladder 102 into the interior pumping chamber of the pump 110 (which also is integrally formed as part of the overall bladder construction of system 200), and valve 114 is provided within or at one end of this fluid transfer line 112. In the system 200 of FIG. 2A, however, three fluid transfer lines 206, 210, and 216 meet at the fluid flow control system 108. More specifically: (a) one fluid transfer line 206 extends from the foot support bladder 102 to the fluid flow control system 108, (b) another fluid transfer line 210 extends from the pump 110 to the fluid flow control system 108, and (c) another fluid transfer line 216 extends from the fluid flow control system 108 to the fluid reservoir bladder 104. Additionally, in this illustrated example system 200, the reserve reservoir 120 is provided as a bladder volume at or near the fluid flow control system 108 (and it is connected to other fluid transfer lines via a short fluid transfer line 222). The flow control system 108 includes structures (e.g., physical elements) to selectively "pinch off" or close electronically or manually controlled flow stop members (such as pinching elements or valves), etc.) to control fluid transfer through one or more of fluid transfer lines 206, 210, 216, and/or 222, as will be described in more detail below. The flow control system 108 may include a switch 108S (e.g., a dial) for physically and/or manually moving the "pinch off" structures or otherwise selectively opening/closing one or more of fluid transfer lines 206, 210, 216, and/or 222 and/or may include an input system 1081 for receiving input commands (e.g., wirelessly or via a wired connection from an electronic device 170, such as a smart phone, etc.) for changing foot support pressure, as will be described in more detail below.

To move between bladder 102 and bladder 104 in the system 200 of FIGS. 2A-2D, fluid moves through line 206, through the fluid flow control system 108, and through line 216 or in the opposite direction. To move from pump 110 to bladder 104 in the system 200 of FIGS. 2A-2D, fluid moves through line 210, through the fluid flow control system 108, and through line 216. To move between the pump 110 and the reserve reservoir 120, fluid moves through line 210, through the fluid flow control system 108, and through line 222 or in the opposite direction. To move between the fluid reservoir 104 and the reserve reservoir 120, fluid moves through line 216, through fluid flow control system 108, and through line 222 or in the opposite direction. The fluid control system 108 can selectively interconnect the lines 206, 210, 216, and/or 222 (e.g., by selectively opening or closing (e.g., pinching shut) any line or combination of lines) to allow any of these desired flow path line interconnections.

The bladder chambers/fluid tight bladders of foot support systems 100 and 200 described above may be formed, e.g., from sheets of thermoplastic material as are conventionally known and used in the footwear arts. Two or more of the components (e.g., any two or more of foot support bladder 102, fluid reservoir bladder 104, arch support portion 104A, reserve reservoir bladder 120, pump chamber 110, and/or one or more of the various fluid transfer/flow paths 106, 112, 116, 122, 124, 206, 210, 216) may be integrally formed as a unitary, one piece construction from two sheets of thermoplastic material 130A/130B sealed together at a seam or weld line 130C (thermoplastic sheet 130B is covered by thermoplastic sheet 130A in the views shown in FIGS. 1A and 2A). In at least some examples of this invention, all of foot support bladder 102, fluid reservoir bladder 104, arch support portion 104A, reserve reservoir bladder 120, pump chamber 110, and the fluid transfer/flow paths (e.g., 106, 112, 116/210, 122/222, 124, 106/206, 116/216) will be formed as a unitary, one piece construction from two sheets of thermoplastic material 130A/130B sealed together at a seam or weld line 130C.

Figure 2C:
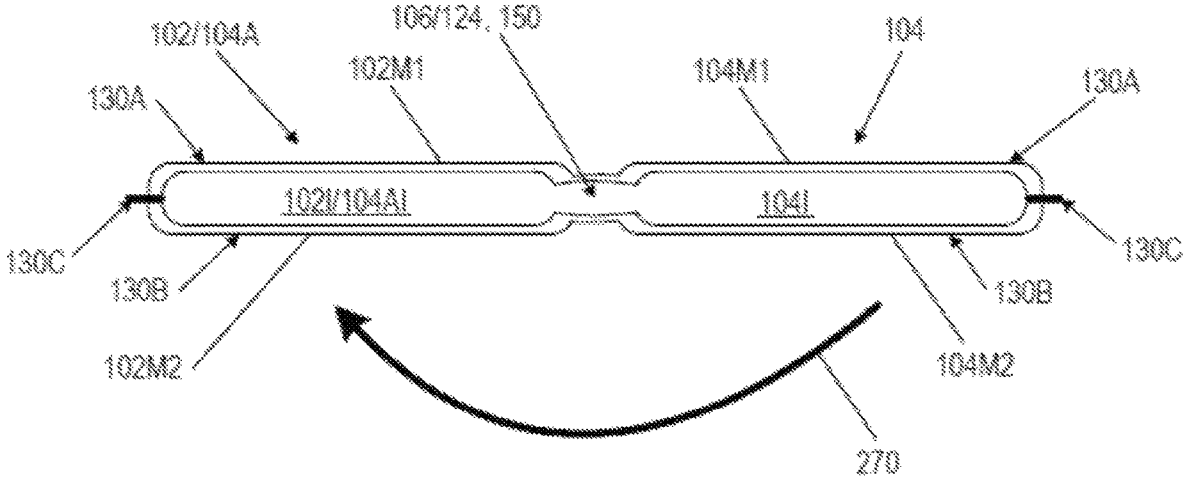
Figure 2D:
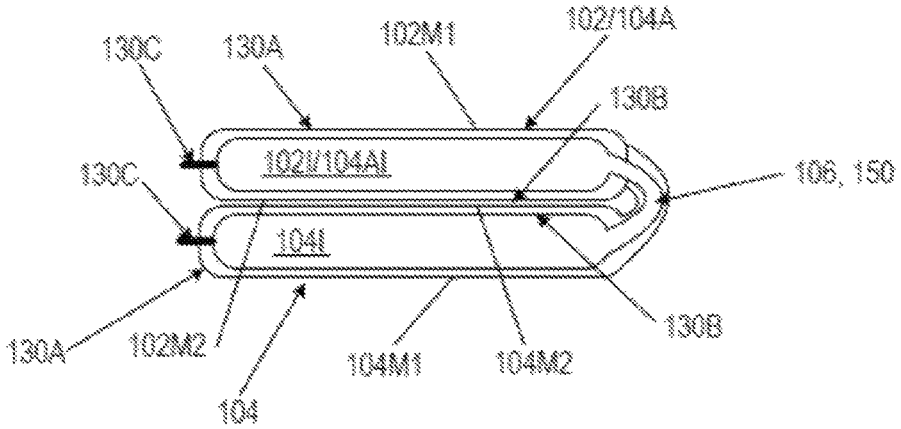

The cross sectional views of FIGS. 2C and 2D provide additional details regarding production/formation of bladder components (e.g., folded bladder configurations and/or vertically "stacked" bladder configurations) for systems 100, 200 in accordance with at least some examples of this invention. As shown, the chambers (e.g., foot support bladder chamber 102 and fluid reservoir bladder chamber 104 or fluid reservoir bladder chamber 104 and arch support portion bladder chamber 104AI) are initially formed laterally alongside one another from a top thermoplastic sheet 130A sealed to a bottom thermoplastic sheet 130B via a seal line 130C (e.g., by a "welding" or thermoforming operation). During the bladder production process, the top thermoplastic sheet 130A forms a top major surface 102M1 of the foot support bladder chamber 102 (or arch support portion bladder chamber 104A) and a top major surface 104M1 of the fluid reservoir bladder 104 as a continuous sheet, as shown in FIG. 2C. Similarly, as also shown in FIG. 2C, the bottom thermoplastic sheet 130B forms a bottom major surface 102M2 of the foot support bladder chamber 102 (or arch support portion bladder chamber 104A) and a bottom major surface 104M2 of the fluid reservoir bladder 104 as a continuous sheet. The interior chambers 102I (or 104AI) and 104I are defined between the welded sheets 130A, 130B. A fluid flow line 106/124 also is integrally formed between the two sheets 130A and 130B, thereby placing interior chamber 102I (or 104AI) and interior chamber 104I in fluid communication with one another.

Then, during the foot support production process, as shown in FIGS. 2C and 2D, the fluid reservoir bladder chamber 104 is folded or moved beneath the foot support bladder chamber 102 (or arch support portion 104A) (shown by arrow 270) about fluid transfer line 106 (or line 124) so that the bottom major surface 104M2 of the fluid reservoir bladder chamber 104 rotates to face and lie immediately adjacent the bottom major surface 102M2 of the foot support bladder chamber 102 (or arch support portion 104A). This creates the vertically stacked bladder chamber configuration, as shown in FIG. 2D. As further shown, in the final, vertically stacked bladder chamber configuration, the top major surface 102M1 of the foot support bladder chamber 102 (or arch support portion 104A) (which lies closest to and supports at least some portion of a plantar surface of the wearer's foot) faces away from the originally top major surface 104M1 of the fluid reservoir bladder chamber 104.

As shown in FIGS. 1A, 1C, 1D, and 2A, foot support bladder chambers 102 of this type may be sized and shaped so as to provide a support surface for supporting a majority of a plantar surface of a user's foot. In the structure shown in FIGS. 2A-2D, the fluid reservoir fluid-filled bladder chamber 104 may be sized and shaped such that its major surface 104M2 lies facing and/or directly adjacent (and optionally in direct contact with) at least 60% of a total surface area of the major surface 102M2 of the foot support bladder chamber 102 (or arch support portion 104A) (and optionally facing, directly adjacent, and/or in direct contact with at least 70%, at least 80%, at least 90%, or even 100% of a total surface area of the major surface 102M2 of the foot support bladder chamber 102 (or arch support portion 104A)).

The foot support bladder chamber(s) 102 and the fluid reservoir bladder chamber(s) 104 present in an individual foot support system 100/200 and/or article of footwear 1000 may have any desired relative sizes and/or volumes without departing from this invention (e.g., provided sufficient volume exists to create the pressure change features described in more detail below, e.g., with respect to FIGS. 3A-4C). In some more specific examples of this invention, the volume ratio between the fluid reservoir bladder chamber(s) 104 and the foot support bladder chamber(s) 102 (e.g., $V_{102I}/V_{102I}$, where "V" represents the fluid volume of the respective interior chambers) present in an individual foot support system 100/200 and/or article of footwear 1000 may be within the range of at least 0.75, and in some examples, at least 1, at least 1.25, at least 1.5, at least 1.75, or even at least 2. In some examples, this volume ratio (e.g., $V_{104I}/V_{102I}$) in an individual foot support system 100/200 and/or article of footwear 1000 may be within the range from 0.75 to 8, and in some examples, from 1 to 6, from 1.25 to 5, from 1.25 to 4, or even from 1.25 to 2.5. In at least some examples of this invention, the fluid reservoir bladder chamber(s) 104 will define a larger interior volume than the foot support bladder chamber(s) 102 in an individual foot support system 100/200 and/or article of footwear 1000. These relative size/volume features may apply to the foot support systems 100 shown in FIGS. 1A-1H, the foot support systems 200 shown in FIGS. 2A-2F, and/or in any of the foot support systems and/or articles of footwear described in more detail below.

In the specific example of the invention shown in FIGS. 2A-2D, the two sheets 130A and 130B of thermoplastic material are sealed together at seal lines 130C and are shaped to form at least: (a) a first fluid-filled bladder chamber (e.g., foot support bladder chamber 102 or arch support portion 104A) defining a first interior chamber (e.g., chamber 102I or chamber 104AI) between the first sheet of thermoplastic material 130A and the second sheet of thermoplastic material 130B; (b) a second fluid-filled bladder chamber (e.g., fluid reservoir chamber 104) defining a second interior chamber (e.g., chamber 104I) between the first sheet of thermoplastic material 130A and the second sheet of thermoplastic material 130B; and (c) a first fluid flow line (e.g., fluid transfer line 106 (FIG. 1A) or lines 206 and 216, FIG. 2A) or line 124 in FIG. 2A) placing the first interior chamber 102I (or 104AI) and the second interior chamber 104I in fluid communication with one another. In at least some examples of this aspect of the invention, this first fluid flow line (e.g., fluid transfer line 106 (or line 124)) may be the only direct fluid connection between the first interior chamber (e.g., chamber 102I (or chamber 104AI)) and the second interior chamber (e.g., chamber 104I). The fluid flow line (e.g., fluid transfer line 106 (or line 124)) made in this step may have any of the size, shape, cross sectional area, and/or volume features described above for the fluid transfer lines.

If desired, as further shown in FIGS. 1A and 2A, the two thermoplastic sheets 130A and 130B may be joined together at seal lines 130C that are shaped so as to additionally form one or more of: (a) a pump portion 110 including an internal pump chamber (e.g., a pump chamber compressible by a wearer's foot, such as a bulb type pump chamber); (b) a second fluid flow line (e.g., line 112) placing the first interior chamber 102I (e.g., of foot support bladder 102) in fluid communication with the internal chamber of the pump 110; (c) a third fluid flow line (e.g., line 116 (FIG. 1A) or lines 210 and 216 (FIG. 2A)) placing the internal chamber of pump 110 in fluid communication with the second interior chamber 104I (e.g., of fluid reservoir bladder 104); (d) a reserve fluid chamber (e.g., chamber 120); (e) a fourth fluid flow line (e.g., line 122 (FIG. 1A) or line 222 (FIG. 2A)

placing the reserve fluid chamber 120 in fluid communication with at least one of the second interior chamber (104), the internal chamber of the pump 110, or the third fluid flow line (e.g., line 116 (FIG. 1A) or lines 210 and 216 (FIG. 2A))); (f) the arch support portion 104A; and/or (g) the fluid flow line (e.g., line 124) connecting the interior chamber 104I with an interior chamber 104AI of arch support portion 104A. FIG. 2A further shows that the two thermoplastic sheets 130A and 130B may be joined together to form one or more inflation inlets 250, to which a fluid source (e.g., a compressed gas source) can be engaged to permit inflation of the bladder chamber(s). The inflation inlet(s) 250 may be permanently sealed (e.g., by a weld operation) or releasably sealed (e.g., with a valve or pinch-off device) after inflation of the bladder chamber(s) to the desired inflation pressure(s).

As further shown in these figures, the first fluid-filled bladder chamber (e.g., foot support chamber 102 or arch support portion 104A) is movable with respect to the second fluid-filled bladder chamber (e.g., fluid reservoir bladder 104) in a manner so that in the foot support system 200: (a) a portion of an exterior surface 102M2 of the second sheet of thermoplastic material 130B defining the first fluid-filled bladder chamber (e.g., foot support bladder chamber 102 or arch support portion 104A) directly faces (and optionally directly contacts) a portion of the exterior surface 104M2 of the second sheet of thermoplastic material 130B defining the second fluid-filled bladder chamber (e.g., fluid reservoir bladder 104) and (b) a portion of an exterior surface 102M1 of the first sheet of thermoplastic material 130A defining the first fluid-filled bladder chamber (e.g., foot support bladder chamber 102 or arch support portion 104A) faces away from a portion of the exterior surface 104M1 of the first sheet of thermoplastic material 130A defining the second fluid-filled bladder chamber (e.g., fluid reservoir chamber 104). For the first fluid flow line (e.g., fluid transfer line 106 or line 124), the bladders may be formed to include one or more of a non-linear portion, in a U-shape, in a zig-zag or herringbone structure, with flow support systems, anti-pinch/anti-kink structures, etc., e.g., in any of the manners described above with respect to FIGS. 1E-1H(2).

Alternatively, rather than the "vertically stacked" arrangement of FIGS. 2A-2D, during production of the foot support system 100, the first fluid-filled bladder chamber (e.g., foot support chamber 102) may be oriented to support a plantar surface of a user's foot and the second fluid-filled bladder chamber (e.g., fluid reservoir chamber 104) may be moved/folded, e.g., by about 90°, so as to extend around a portion of a perimeter edge 102E of the first fluid-filled bladder chamber 102, e.g., as shown in FIGS. 1A and 1B.

In the examples of the invention shown in FIGS. 1A-2D, at least one of the first fluid-filled bladder chamber (e.g., foot support bladder 102 and/or arch support portion 104A) and the second fluid-filled bladder chamber (e.g., 104)) is engaged with the footwear sole structure 1004, and in the vertically stacked arrangement shown in FIGS. 2A-2D, at least the second fluid-filled bladder chamber (e.g., fluid reservoir bladder 104) is engaged with the footwear sole structure 1004. As shown in FIG. 2B, this footwear sole structure 1004 may include a polymeric foam material (e.g., when formed as a midsole) and/or a rubber or thermoplastic material (e.g., when formed as an outsole) that has an interior surface 1004A covering (and optionally in direct contact with) at least a majority (and optionally at least 60%, at least 70%, at least 80%, at least 90%, or even 100%) of a bottom surface 104B (FIG. 2B), 104M1 (FIG. 2D) of the second fluid-filled bladder chamber (e.g., fluid reservoir bladder 104). As shown in the examples of FIGS. 1C, 1D, and 2B, these example footwear sole structures 1004 include an upper surface 1004U and a bottom surface 1004B, wherein the upper surface 1004U includes a recess 1004R defined therein, and wherein at least the first fluid-filled bladder chamber (e.g., foot support bladder 102 or arch support portion 104A) and/or at least the second fluid-filled bladder chamber (e.g., fluid reservoir bladder 104) is received in the recess 1004R. The lowermost foot support system 100, 200 component (e.g., bottom surface 104B/104M1 of fluid reservoir bladder 104 or bottom surface 102B/102M2 of foot support bladder 102/arch support portion 104A) may be engaged (e.g., by adhesive or cement, by mechanical connectors, etc.) with the bottom interior surface 1004A in the recess 1004R of sole component 1004.

Figure 2E:
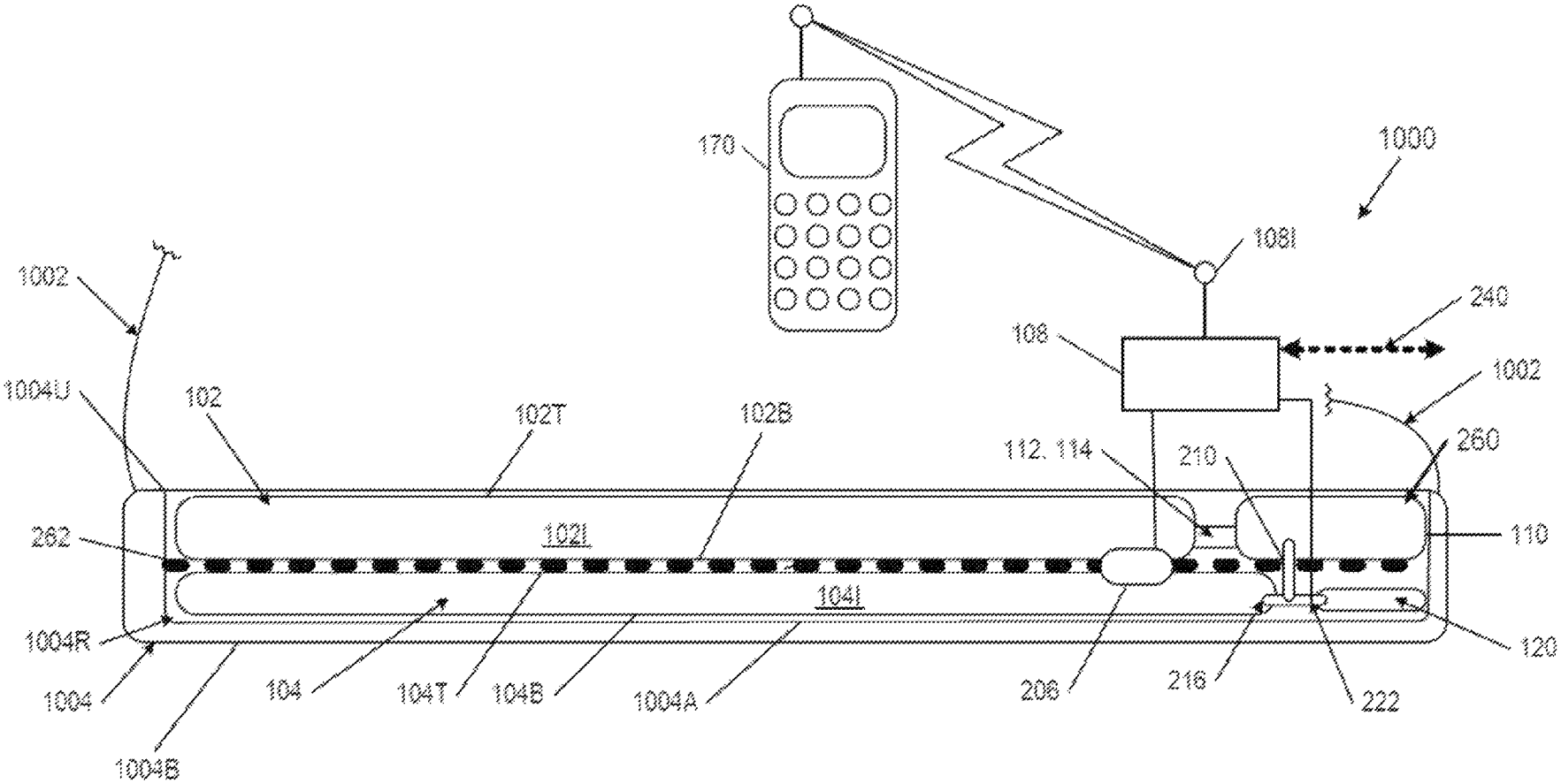

FIGS. 2A-2D illustrate example foot support systems 200 and articles of footwear 1000 in which a major surface (e.g., bottom surface 102B) of the foot support bladder 102 lies directly adjacent and optionally directly in contact with a major surface (e.g., top surface 104T) of the fluid reservoir bladder 104. Other options are possible, e.g., as shown in FIG. 2E. FIG. 2E illustrates an example foot support system 260 similar to that of FIGS. 2A-2D, and similar reference numbers are used in FIG. 2E as used in FIGS. 2A-2D and much of the redundant description is omitted. The foot support system 260 of FIG. 2E may have any one or more of the specific features, characteristics, properties, structures, options, and the like of the example foot support systems 200 described above with respect to FIGS. 2A-2D.

In the foot support structure 260 of FIG. 2E, however, one or more separating members 262 are provided between the foot support bladder 102 and the fluid reservoir bladder 104 (e.g., between the bottom surface 102B of the foot support bladder 102 and the top surface 104T of the fluid reservoir bladder 104). Thus, in this example construction, the bottom major surface 102B of the foot support bladder 102 does not lie directly adjacent and does not directly contact the top major surface 104T of the fluid reservoir bladder 104 over at least some portion(s) of their respective facing surface areas (e.g., over at least 50% of their facing surface area, over at least 75% of their facing surface area, over at least 90% of their facing surface area, over at least 95% of their facing surface area, or even over 100% of their facing surface area). The separating member 262 may be: (a) one or more relatively stiff or rigid plate members (e.g., carbon fiber plates, thermoplastic and/or thermosetting polyurethane plates, fiberglass plates, other moderator plates, etc.) to disperse forces over a wider area; (b) one or more foam members (e.g., ethylvinyl acetate foams, polyurethane foams, etc.) to provide additional impact force attenuation; (c) a combination of plate(s) and foam(s) (e.g., vertically stacked and/or present at separated areas over their facing surface area); and/or (d) other component(s). Such separating member(s) 262 can be useful, for example, to control the impact force attenuation, "feel," and/or responsiveness characteristics of the foot support system 260.

Figure 2F:
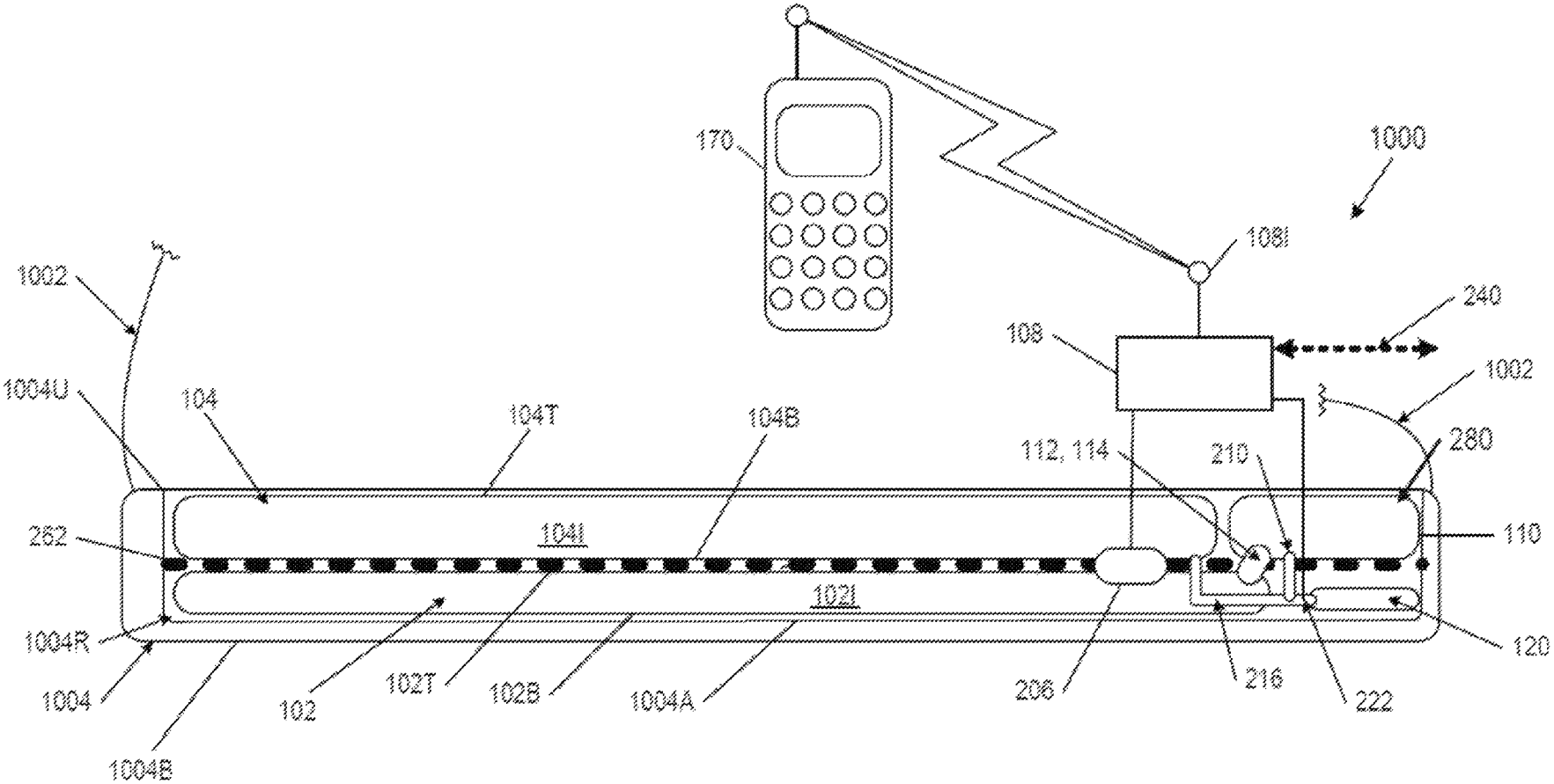

FIGS. 2A-2E illustrate example foot support systems 200/260 and articles of footwear 1000 including vertically stacked bladders in which the foot support bladder 102 lies closest to the wearer's foot and the fluid reservoir bladder 104 lies beneath the foot support bladder 102. These bladders 102/104 may be vertically inverted, e.g., as shown in the example foot support structure 280 of FIG. 2F (with fluid reservoir bladder 104 vertically stacked and located above foot support bladder 102). Similar reference numbers are used in FIG. 2F as in FIGS. 2A-2E and much of the redundant description is omitted. The foot support system 280 of FIG. 2F may have any one or more of the specific features, characteristics, properties, structures, options, and the like of the example foot support systems 200/260 described above with respect to FIGS. 2A-2E. Also, while FIG. 2F shows an example with separating member(s) 262 present between the bladder facing surfaces 104B/102T, the separating member(s) 262 may be omitted over some or all of the facing surface area, and the bottom major surface 104B of the fluid reservoir bladder 104 may lie directly adjacent and optionally directly contact the top surface 102T of the foot support bladder 102 over at least some extent of their facing surface area.

In the example structures of FIGS. 1A-2F, the foot support systems 100/200/260/280 each may include at least one "nested portion," e.g., in which a portion of one bladder (e.g., portion 104A of fluid reservoir bladder 104) "nests" within a region (e.g., area or volume) defined by the other bladder (e.g., gap region 102G of foot support bladder 102). If desired, additional and/or other "nested portions" may be provided in a foot support system 100/200/260/280. As some more specific examples, one or more portions of fluid reservoir bladder 104 (e.g., like portions 104A) may nest within one or more other regions of the foot support bladder 102 (e.g., like gaps 102G), e.g., in the heel area, in the forefoot area, and/or in the midfoot area of the foot support system 100/200/260/280. An individual foot support system 100/200/260/280 may include one or more of these nested portion 104A/gap 102G type features at any desired area(s) and/or of any desired shape(s). As yet additional or other alternative examples, if desired, one or more gaps may be provided in the fluid reservoir bladder 104 (e.g., like gap 102G) and one or more nested portions (e.g., like portion 104A) may be provided in the foot support bladder 102 and "nest" within the fluid reservoir bladder 104 gap(s). As yet other potential features, a foot support bladder 102 may include at least one gap and at least one "nested" portion that respectively fit together with at least one "nested" portion and at least one gap provided in a fluid reservoir bladder 104. Any desired combination of gaps and nested portions may be provided in foot support structures without departing from this invention.

As described above, two or more of the components (e.g., any two or more (and optionally all) of foot support bladder 102, fluid reservoir bladder 104, arch support portion 104A, reserve reservoir bladder 120, pump chamber 110, and/or one or more of the various fluid transfer/flow paths 106, 112, 116, 122, 124, 206, 210, 216)) may be integrally formed as a unitary, one piece construction from two sheets of thermoplastic material 130A/130B sealed together at a seam or weld line 130C (thermoplastic sheet 130B is covered by thermoplastic sheet 130A in the views shown in FIGS. 1A and 2A). In other examples of this invention, however, at least some of these components (and optionally all of these components), e.g., foot support bladder 102, fluid reservoir bladder 104, arch support portion 104A, reserve reservoir bladder 120, pump chamber 110, and the fluid transfer/flow paths (e.g., 106, 112, 116/210, 122/222, 124, 106/206, 116/216) may be formed as separate parts that are engaged together. As some more specific examples, foot support bladder 102 may be separately formed from fluid reservoir bladder 104, and these individual parts may be connected, e.g., by a line 106 (which also may be a separate part from bladders 102 and 104 or may be integrally formed with one of bladders 102 or 104). Connectors, e.g., akin to inlets 250 (FIG. 2A), may be used with a tube (e.g., for line 106) to connect bladders 102 and 104 (e.g., with line 106 cemented or releasably connected to connectors 250). Additionally or alternatively, pump chamber 110 may be separately formed from and connected to either or both of foot support bladder 102 (e.g., via a separate or integrally formed line 112) and fluid-reservoir bladder 104 (e.g., via a separate or integrally formed line 116). Additionally or alternatively, reserve reservoir bladder 120 may be separately formed from and connected to either or both of pump chamber 120 (e.g., via a separate or integrally formed line 122) and fluid-reservoir bladder 104 (e.g., via a separate or integrally formed line). The various bladders and/or lines may be formed to include connection ports like inlets 250 and/or the various parts may be connected in other ways (e.g., via cements or adhesives, via thermal forming or welding, etc.).

The various bladders (e.g., foot support bladder 102 and fluid reservoir bladder 104) may be made by the same or different production processes and/or may have the same or different structures/constructions without departing from this invention. As some examples, if desired, the bladders 102/104 may be formed by thermoforming, RF-welding, ultrasonic welding, laser welding, or the like. Internal welds may be used (e.g., welding interior surfaces of the bladder surfaces together, e.g., as shown for example in U.S. Pat. No. 6,571,490) to control the shape of the bladder in some example bladders. In other examples, tensile members (e.g., including internal fiber structures, e.g., as shown for example in U.S. Patent Appln. Publn. No. 2015/0013190) may be used to control the shape of the bladder. In some individual example foot support systems 100/200/260/280 and/or articles of footwear 1000 in accordance with this invention, one bladder (e.g., foot support bladder 102) may be formed and shaped controlled by a thermoforming and/or welding process (e.g., with internal welds) and another bladder (e.g., fluid reservoir bladder 104) may be formed and shape controlled using tensile members. Any desired combinations of bladder constructions and shape control methods may be used in individual foot support systems 100/200/260/280 and/or articles of footwear 1000. Each of U.S. Pat. No. 6,571,490 and U.S. Patent Appln. Publn. No. 2015/0013190 is entirely incorporated herein by reference.

Movement of fluid in at least some example foot support systems 100, 200 now will be described in more detail in conjunction with FIGS. 3A-3C. In these specifically illustrated example systems 100, 200, the systems 100, 200 are closed systems in that they do not purposefully take in fluid (e.g., air or other gas) from the exterior environment and they do not purposely release fluid to the exterior environment. Rather, the fluid is moved between various different bladder chambers or other structures in fluid communication within the system 100, 200 (e.g., foot support bladder 102, fluid reservoir bladder 104, and/or reserve reservoir 120) in order to place and hold the foot support bladder 102 at three discrete pressure settings (and thus three discrete foot support hardness settings).

Figure 3A:
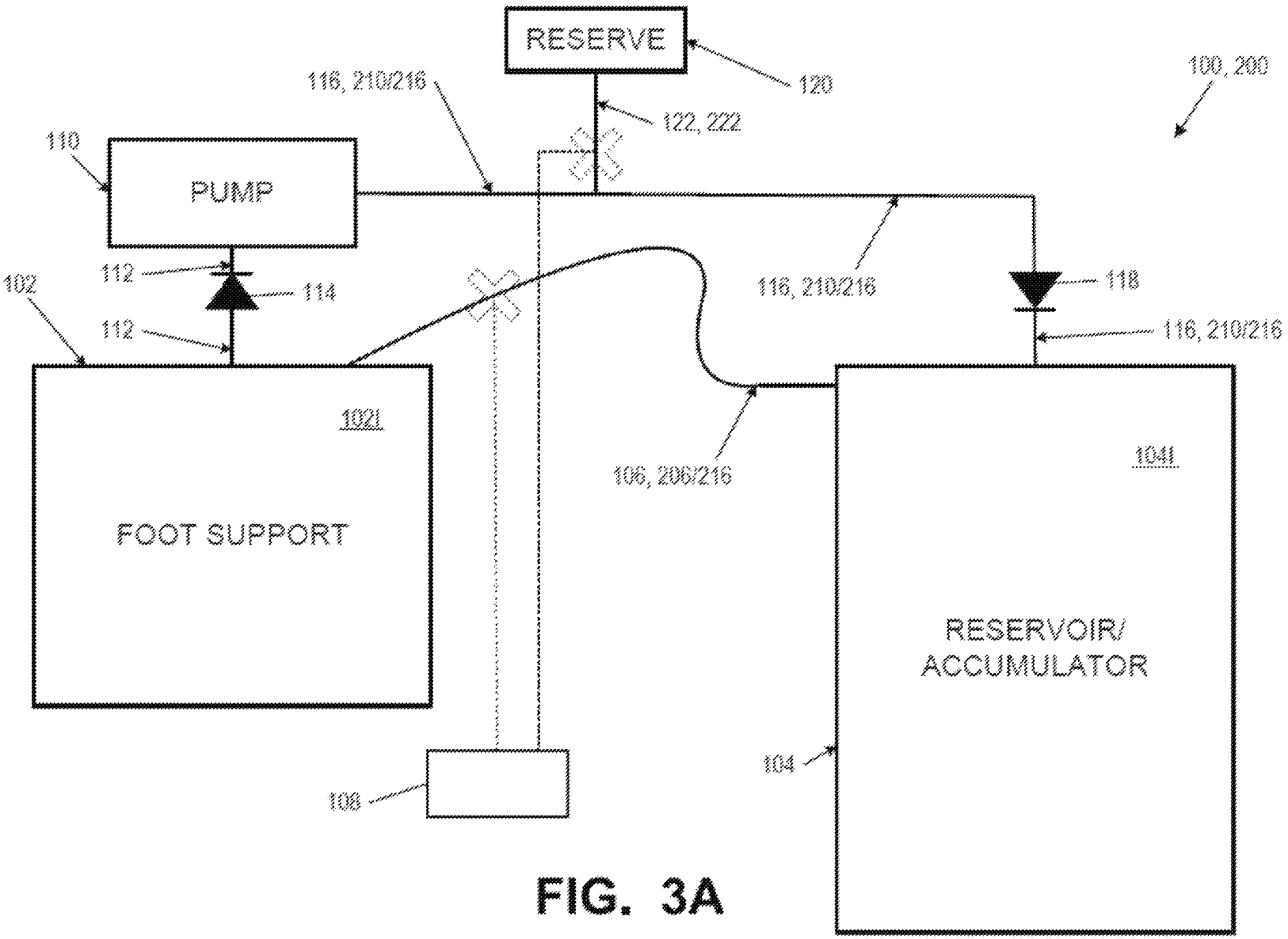
FIGS. 3A-3H illustrate various features of fluid transfer and/or fluid pressure changes in accordance with various examples and aspects of this invention.

FIG. 3A shows one configuration of these example systems 100, 200 with the foot support bladder 102 at its highest (or firmest) foot support pressure and the reservoir bladder 104 at its lowest pressure. While other pressures are possible, in one example system in accordance with this aspect of the invention, the pressure of the overall bladder system 100, 200 may be constant in this configuration, e.g., with fluid able to flow through fluid transfer lines 112; 116, 210/216; 122, 222; 116, 210/216; and 106, 206/216. Valve 114 (e.g., a one way valve) prevents fluid from flowing from pump 110 back into the foot support bladder 102 via line 112 and valve 118 (e.g., a one way valve) prevents fluid from flowing from fluid reservoir bladder 104 back into the pump 110 via lines 116, 210/216. As the pump 110 pushes fluid from the pump chamber into line 116, 210/216 (by activation of pump 110 via activator 126 with a user's foot), the fluid moves freely through the system 100, 200 to the reserve reservoir 122 and the fluid reservoir 104 and between the fluid reservoir 104 and the foot support bladder 102 (via fluid transfer line 106, 206/216) until the overall system 100, 200 reaches a constant fluid pressure. As a more specific example, in the configuration of FIG. 3A, foot support bladder 102, reservoir bladder 104, reserve bladder 120, and the pump 110 may be at a relatively constant pressure, e.g., 25 psi (±10% or ±5 psi). Thus, in this configuration, foot support bladder 102 may be at its highest foot support pressure condition (e.g., 25 psi (±10%), between 20 psi and 30 psi, etc.), fluid reservoir bladder 104 may be at its lowest pressure condition (e.g., 25 psi (±10%), between 20 psi and 30 psi, etc.), and reserve reservoir bladder 120 may be at its lowest pressure condition (e.g., 25 psi (±10%), between 20 psi and 30 psi, etc.).

If desired, a check valve may be provided in the fluid transfer line 106, 206/216 between the reservoir bladder 104 and the foot support bladder 102. This check valve, when present, may help the foot support bladder 102 to feel somewhat firmer than would be the case when the fluid transfer line 106, 206/216 between the reservoir 104 and the foot support bladder 102 is in an open condition.

Figure 3B:
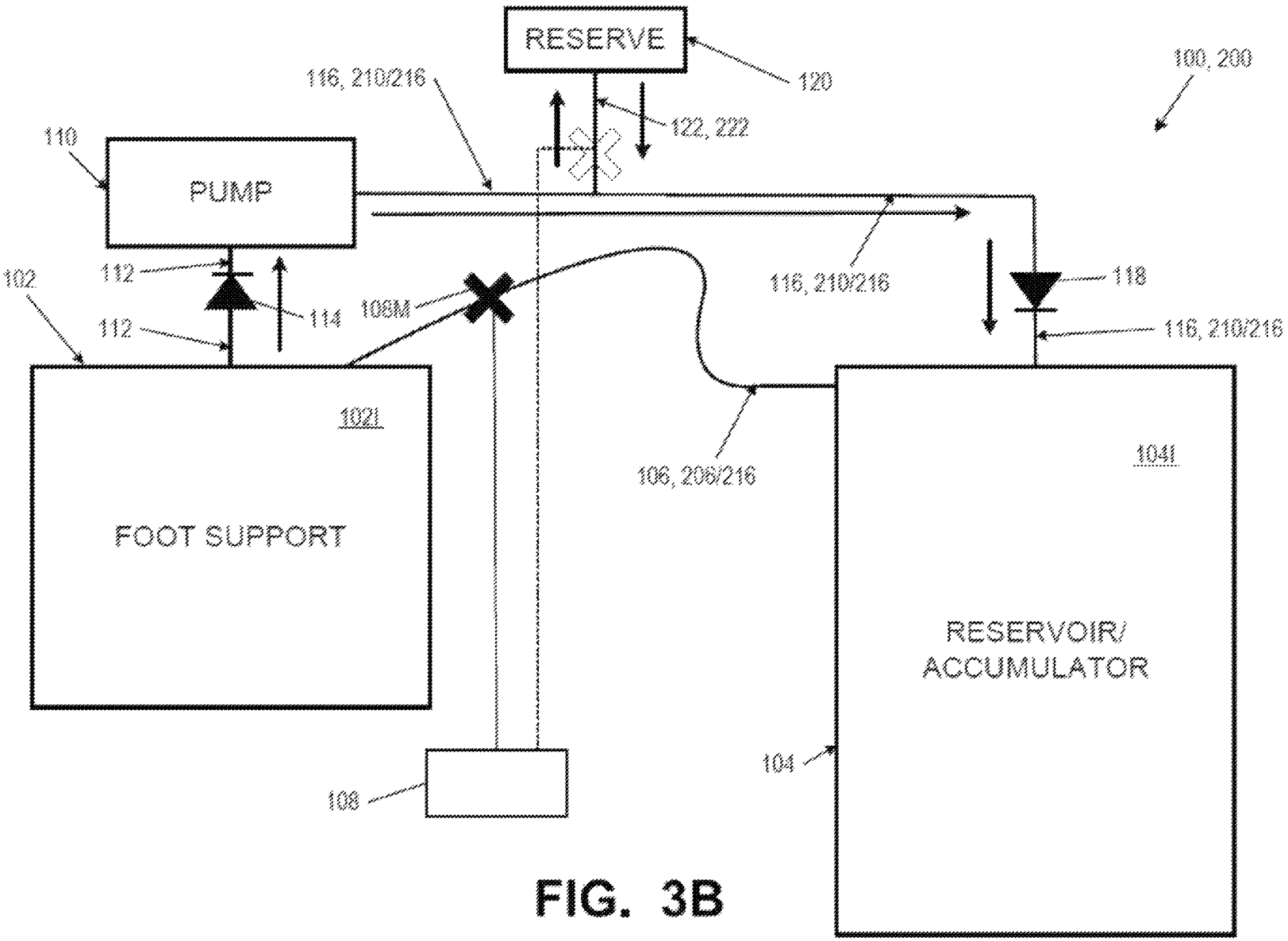

In use, a user then may change the system 100, 200 from this firmest foot support condition (FIG. 3A) to a "medium firmness" foot support condition, as shown in FIG. 3B. This may be accomplished, for example, by turning switch 108S in FIGS. 1B and 2A from the "25" or "F" (firm) setting to the "17" or "M" (medium) setting. As other options, the firmness setting may be changed electronically (e.g., using an input system, such as input device 170 of FIG. 2B). When this change is made, the system 100, 200 changes to the configuration shown in FIG. 3B. More specifically, in this change, the fluid control system 108 closes off fluid transfer line 106, 206/216 between fluid reservoir bladder 104 and foot support bladder 102 (but the other fluid transfer lines (e.g., 116, 210/216 and 122, 222) remain open. In this configuration, fluid moves from the foot support bladder 102 into pump 110 via line 112, from where it is pumped through use of activator 126 to further inflate reserve reservoir bladder 120 and fluid reservoir bladder 104. But, because fluid is prevented from moving from fluid reservoir bladder 104 back into foot support bladder 102 (by the stop 108M), this pumping action takes some fluid out of foot support bladder 102 (thereby decreasing its pressure) and adds fluid into fluid reservoir bladder 104 and reserve reservoir bladder 120 (thereby increasing their pressures).

Pressure is increased in fluid reservoir bladder 104 and reserve reservoir bladder 120 (via the step cycle pumping action of pump 110) until the pressure is high enough in these bladders that activation of the pump 110 through a single pump stroke cycle (e.g., a single downward press of activator 126) is insufficient to move more fluid into reserve reservoir 120 and/or fluid reservoir 104. More specifically, in this illustrated example, the pump 110 is integrally formed as part of the fluid filled bladder system 100, 200 such that the pump is a "bulb" type pump that is activated by a foot (e.g., when a user makes a step). In other words, the user's step will compress the pump 110 bulb and, because of the valve 114, this compression will force a volume of fluid out of the pump 110 chamber and into fluid transfer line 116, 210/216. Thus, the pump 110 chamber of this example is structured to define a "maximum fluid pumping volume," which constitutes a maximum fluid volume that can be moved by the pump 110 in a single stroke cycle of the pump 110 (i.e., in a single step or compression). A volume of fluid equal to or less than the maximum fluid pumping volume will be moved during a single stroke cycle of the pump 110 (e.g., each individual pump stroke need not move the maximum fluid pumping volume). As it is pumped into line 116, 210/216, the additional fluid increases the fluid pressure in lines 116, 210/216 and 122, 222 and bladders 104 and 120, and valve 118 will prevent fluid from returning to lines 116, 210/216 after it gets into fluid reservoir 104. After one or more pump 110 bulb compression cycles, the volume of fluid moved during a pump 110 stroke cycle will not be sufficient to move additional fluid past the valve 118 and into the fluid reservoir bladder 104. In other words, over time and sufficient pump cycles, the pressure within fluid reservoir bladder 104 will become high enough so that the maximum volume of fluid moved during a pump stroke cycle will be insufficient to increase the fluid pressure in lines 116, 210/216 and 122, 222 to move more fluid past the valve 118. At this stage, the system 100, 200 reaches its second "steady state" (medium foot support firmness) pressure level. At this configuration (steady state in the configuration of FIG. 3B), the foot support bladder 102 will be at its "medium" firmness pressure (e.g., 17 psi (±10%), between 12 psi and 22 psi, etc.), and the fluid reservoir bladder 104, reserve bladder 120, and the pump 110 (as well as their connecting lines 116, 210/216 and 122, 222) will be at a constant, but higher pressure, e.g., 31 psi (±10%), between 26 psi and 36 psi, etc. The volume of the fluid transfer lines 116, 210/216 and 122, 222 and bladders 104 and 120 may be selected with respect to the pump 110 maximum pump cycle volume so that the medium pressure condition reaches its steady state pressure at a desired pressure level.

Figure 3C:
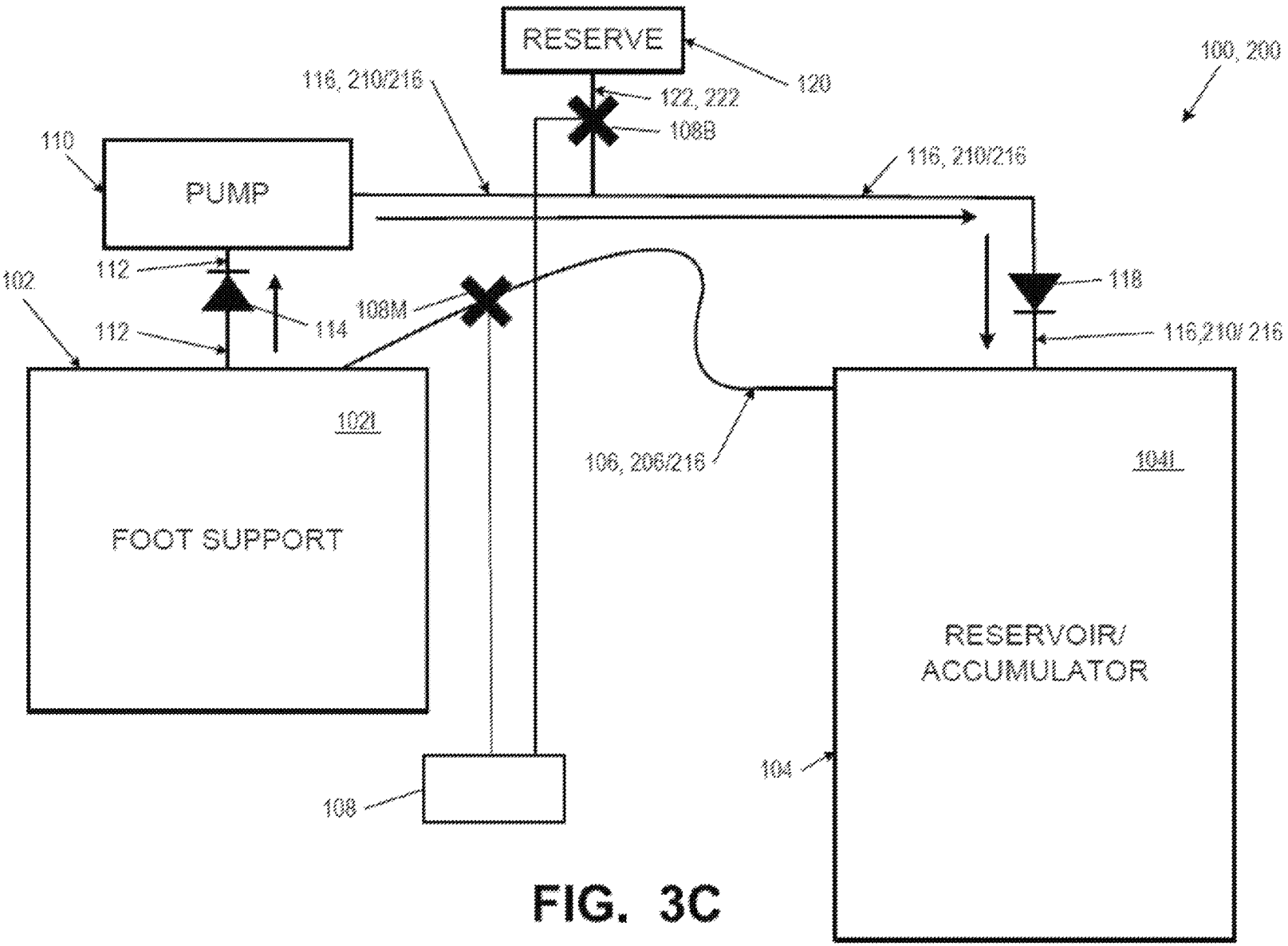

In further use, a user also may change the system 100, 200 from this medium pressure foot support condition (FIG. 3B) to a "lowest firmness" foot support condition, as shown in FIG. 3C. This may be accomplished, for example, by turning switch 108S in FIGS. 1B and 2A from the "17" or "M" (medium) setting to the "10" or "S" (soft) setting. Again, as other options, the firmness setting may be changed electronically (e.g., using an input system, such as input device 170 of FIG. 2B). When this change is made, the system 100, 200 changes to the configuration shown in FIG. 3C. More specifically, in this change, the fluid control system 108 additionally closes off fluid transfer line 122, 222 to the reserve reservoir bladder 120, but fluid transfer lines 116, 210/216 remain open. Therefore, in this configuration, fluid moves from the foot support bladder 102 into pump 110, from where it is pumped to further inflate fluid reservoir bladder 104. But, because fluid is prevented from moving from fluid reservoir bladder 104 back into foot support bladder 102 (by the stop 108M) and because fluid is prevented from moving from the pump 110 into reserve reservoir bladder 120 (by the stop 108B), this pumping action takes some additional fluid out of foot support bladder 102 (thereby further decreasing its pressure) and adds fluid into fluid reservoir bladder 104 (thereby further increasing its pressure). Reserve reservoir 120 stays at its previous pressure prior to the switch to the configuration of FIG. 3C.

Pressure is increased in fluid reservoir bladder 104 (via the step cycle pumping action of pump 110) until the pressure is high enough in bladder 104 that activation of the pump 110 through a single pump stroke cycle is insufficient to move more fluid into fluid reservoir 104. More specifically, the compression force of the user's step will compress the pump 110 bulb and, because of the valve 114, this compression will force a volume of fluid out of the pump 110 chamber and into fluid transfer line 116, 210/216. As it is pumped into line 116, 210/216, the additional fluid cannot further increase pressure in line 122/222 and/or reserve reservoir bladder 120 because of stop 108B, but it will increase the fluid pressure in lines 116, 210/216 and fluid reservoir bladder 104, and valve 118 will prevent fluid from returning to lines 116, 210/216 after it gets into fluid reservoir 104. After one or more pump 110 bulb compression cycles, the volume of fluid moved during a pump 110 stroke cycle will not be sufficient to move additional fluid past the valve 118 and into the fluid reservoir bladder 104. In other words, over time, the pressure within fluid reservoir bladder 104 will become high enough so that the maximum volume of fluid moved during a pump 110 compression/stroke cycle will be insufficient to increase the fluid pressure in lines 116, 210/216 to move more fluid past the valve 118. At this stage, the system 100, 200 reaches its third "steady state" (lowest foot support firmness) pressure level. At this configuration (steady state in the configuration of FIG. 3C), the foot support bladder 102 will be at its "softest" firmness pressure (e.g., 10 psi (±10%), between 5 psi and 15 psi, etc.), reserve bladder 120 will remain at the pressure it was at when the switch 108A moved from the medium firmness setting to the softest firmness setting (e.g., 31 psi (±10%), between 20 psi and 36 psi, etc., from FIG. 3B), and the fluid reservoir bladder 104 and the pump 110 (as well as their connecting lines 116, 210/216) may be at a constant, but higher pressure, e.g., 40 psi (±10%), between 35 psi and 50 psi, etc. The volume of the fluid transfer lines 116, 210/216 and 122, 222 and bladders 104 and 120 may be selected with respect to the pump 110 maximum pump cycle volume so that the softest foot support pressure condition reaches its steady state pressure at a desired pressure level.

Further movement of switch 108A in this example will rotate it from the "10" or "S" setting to the "25" or "F" setting shown in FIGS. 1B and 2A. When this occurs, stops 108M and 108B are opened, which switches the system 100, 200 from the configuration shown in FIG. 3C to the configuration shown in FIG. 3A. This change allows fluid to flow from the higher pressure fluid reservoir bladder 104 to the lower pressure foot support bladder 102 (via lines 106, 206/216) and allows fluid exchange between reserve bladder 120 and line(s) 116, 210/216, to thereby equalize the pressure over the entire system 100, 200. In at least some examples of this invention, a user might hear and/or feel this relatively quick change of pressure over the system 100, 200 when stops 108M and 108B are opened.

While the systems 100, 200 and methods described above in conjunction with FIGS. 3A-3C are closed systems, if desired, systems 100, 200 and methods according to at least some examples of this invention may intake new fluid (e.g., air or other gas) from and/or discharge fluid to an external source/area, such as the ambient atmosphere. This possibility is shown in FIG. 2B, for example, as broken arrow 240. Additionally or alternatively, if desired, systems 100, 200 and methods according to at least some examples of this invention may allow a user to "fine tune" one or more of the firmness setting levels, e.g., by interacting with a user interface (which may be provided as part of input device 170). As a more concrete example, the input device 170 and/or the shoe 1000 could include a "pressure increase" button and a "pressure decrease" button with which a user could interact to adjust the pressure in foot support bladder 102 (e.g., in relatively small increments, such as ±0.5 psi per interaction with the interface). Fluid could be moved into or out of bladder 104 and/or into or out of the external environment or other source to alter the support bladder 102 pressure in this manner.

In the example systems 100, 200 described above, the pump 110 can continue to be activated at each step by user interaction with pump activator 126. However, if the pressure level beyond pump 110 (in the fluid flow direction) is sufficiently high (as described above), the fluid will not substantially move out of the pump 110 and/or will not continue to transfer into bladders 104 and/or 120. Thus, further fluid will not be drawn out of the foot support bladder 102, thereby maintaining it at the desired foot support pressure level. Alternatively, if desired, once the foot support bladder 102 is at the desired pressure level for the selected setting, a valve could be activated (or valve 114 could be designed) to stop further transfer of fluid from the foot support bladder 102, at least until the user interacts with the system 100, 200 to indicate a desired change to foot support bladder 102 pressure.

The specific example foot support systems 100, 200 described above have three discrete foot support pressure settings (e.g., as described in conjunction with FIGS. 3A-3C). Other options are possible. For example, a similar foot support system, could be provided that has only two foot support bladder 102 pressure settings (e.g., a "soft" setting and a "firm" setting). This may be accomplished, for example, by eliminating the reserve reservoir bladder 120. In this potential arrangement, the foot support system 100, 200 could simply toggle between the two noted conditions. As another potential option, if desired, the check valves and/or one way valves (e.g., valves 114, 118, other present check valves, etc.) could be reversed in the systems of FIGS. 3A-3C, e.g., to create a system that moves fluid from the reservoir 104 to the foot support bladder 102.

Figure 3D:
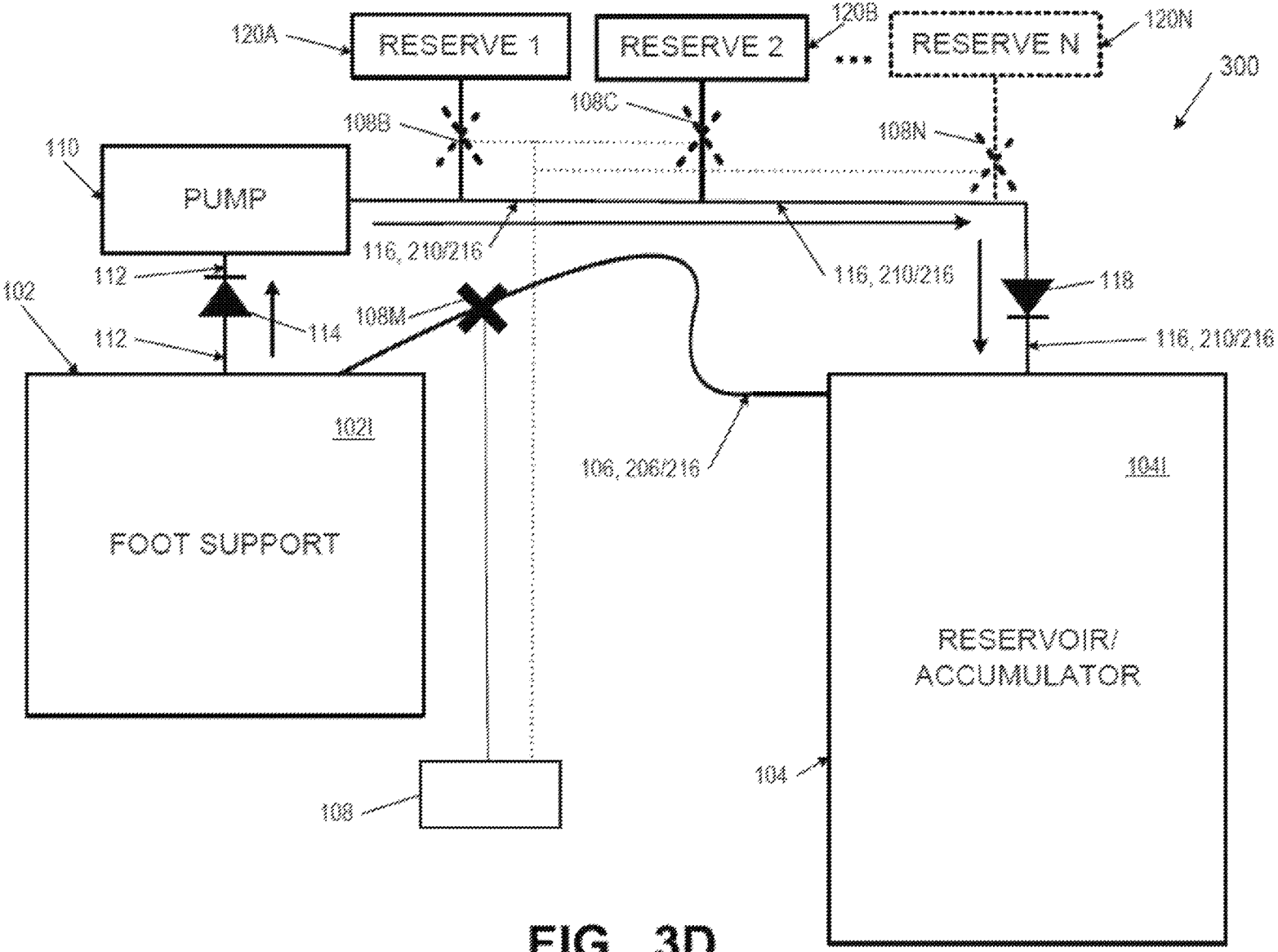

FIG. 3D, however, illustrates another example foot support system 300 having two or more reserve reservoirs 120A, 120B, . . . 120N. By selectively activating zero or more stops 108M, 108B, 108C, . . . 108N (and thus placing zero or more reserve reservoirs 120A, 120B, . . . 120N in the system 300's active fluid volume), different discrete steps or hardness settings in foot support bladder 102 may be achieved, e.g., in the general manner described above in conjunction with FIGS. 3A-3C. In general, the greater number of reserve reservoirs 120A, 120B, . . . 120N (or the greater the available combined volume of reserve reservoir volumes available for accepting fluid from pump 110), the lower the pressure setting in the foot support bladder 102 (as more fluid can be pumped out of bladder 102 into the higher available reserve reservoir volume). The reserve reservoirs 120A, 120B, . . . 120N may have the same or different volumes from one another, and they may be activated individually or in any desired combination(s), in order to alter the reserve reservoir volume available for accepting fluid from the pump 110 during a pump activation cycle. While conceivably N could be any desired number, in some examples of this invention, N will be between 0 and 8, and in some examples, between 0 and 6, between 0 and 4, or even between 0 and 3.

Figure 3E:
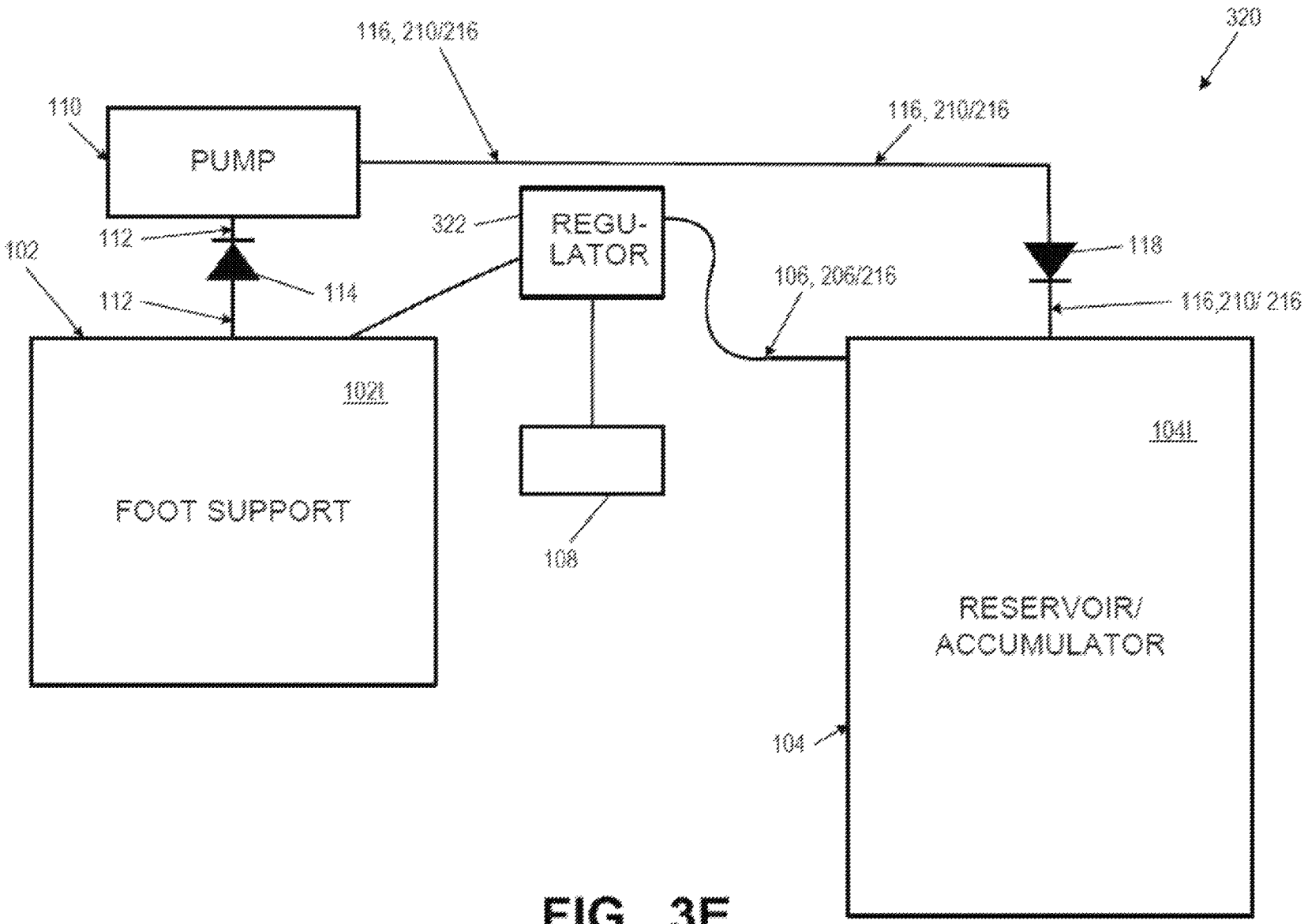
Figure 3F:
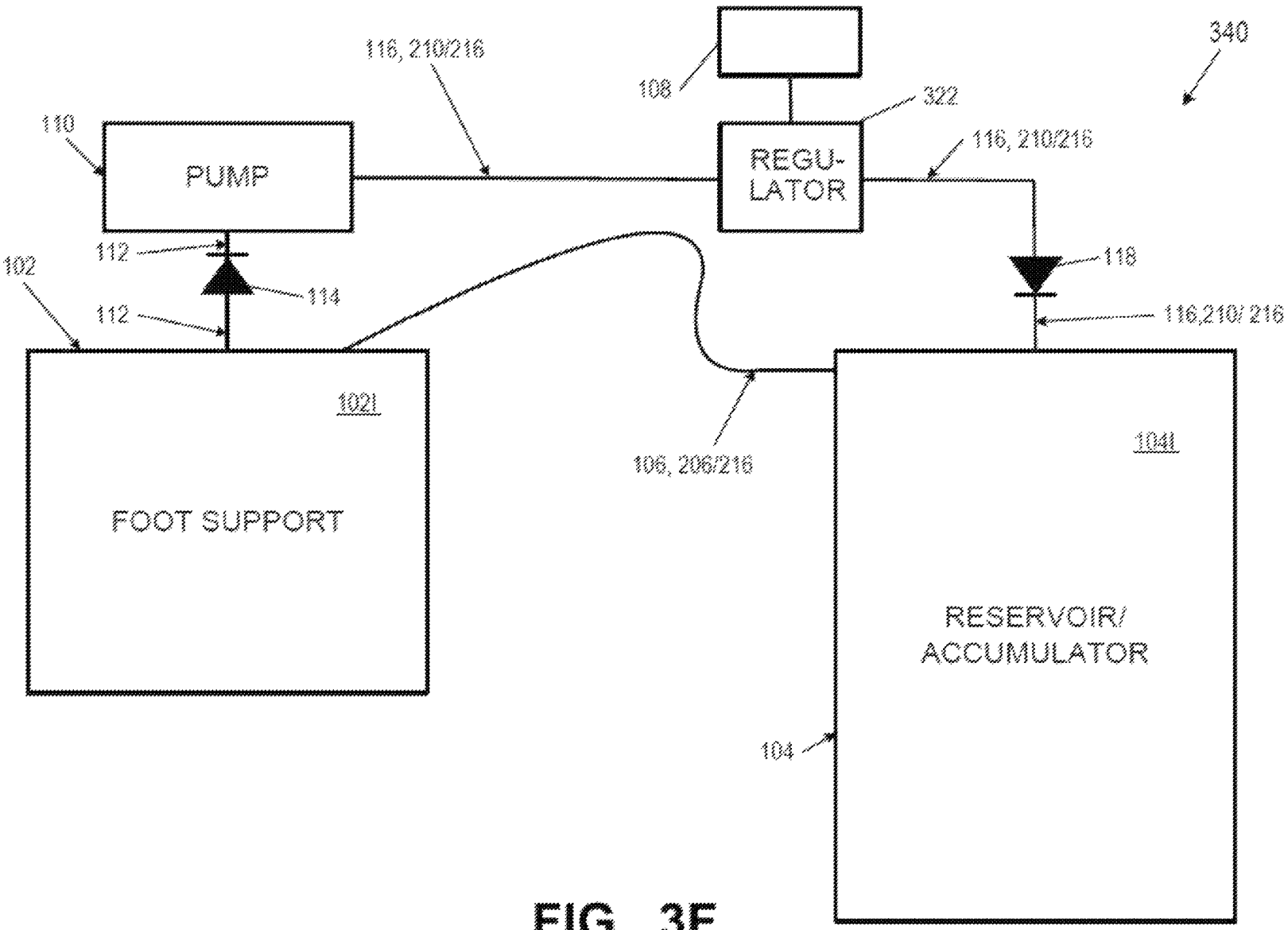

FIGS. 3E and 3F illustrate other example foot support systems 320, 340, respectively, that may be used in accordance with at least some examples of this invention (e.g., in footwear structures of the types shown in FIGS. 1B, 2B, 2E, and 2F). These example foot support systems 320, 340 may include foot support bladders 102 and fluid reservoir bladders 104, e.g., of the various types and functions described above (e.g., and potentially in the various orientations and structural arrangements described above). When the same reference numbers are used in FIGS. 3E and 3F as those used in FIGS. 1A-3D above, the same or similar parts are being referred to, and a complete/detailed description of the various parts may be omitted. The foot support systems 320/340 of FIGS. 3E and/or 3F may have any one or more of the specific features, characteristics, properties, structures, options, and the like of the examples described above with respect to FIGS. 1A-3D.

In the examples of FIGS. 1A-3D, the foot support systems include reserve reservoirs 120/120A-120N in the system to enable selection of additional foot support bladder 102 pressure/firmness settings, as described above. The reserve reservoir(s) 120 was (were) included in the system as a branch (via line 122) to a separate bladder chamber, e.g., a branch from the pump chamber 110, the fluid lines 116, 210/216, and/or the fluid reserve reservoir 104. As another option, if desired, as shown in FIGS. 3E and 3F, one or more (and optionally all) of the branch connected reserve reservoir(s) 120/120A-120N may be omitted, e.g., in favor of one or more in-line pressure regulators 322 (mechanically or electronically controlled by control system 108). The in-line pressure regulator(s) 322 may be provided, for example, in one or both of: (a) the fluid flow line 106, 206/216 between the fluid reservoir bladder 104 and the foot support bladder 102, e.g., as shown in FIG. 3E, and/or (b) the fluid flow line 116, 210/216 between the pump chamber 110 and the fluid reservoir bladder 104, e.g., as shown in FIG. 3F. Pressure regulators 322 of this type, which are commercially available, allow fluid to flow until a predetermine pressure differential (ΔP) develops between the inlet end and the outlet end of the regulator 322, at which time further fluid flow through the regulator 322 is stopped. Pressure regulator(s) 322 of these types may be used to provide any desired different numbers of foot support bladder 102 pressure level settings, e.g., from 2-20 settings, and in some examples, from 2-15 settings, from 2-10 settings, or even from 3-8 settings. As another option, rather than discrete individual or stepped pressure settings, pressure regulator(s) 322 of this type could be used to allow a user to freely select any desired setting level.

Figure 3G:
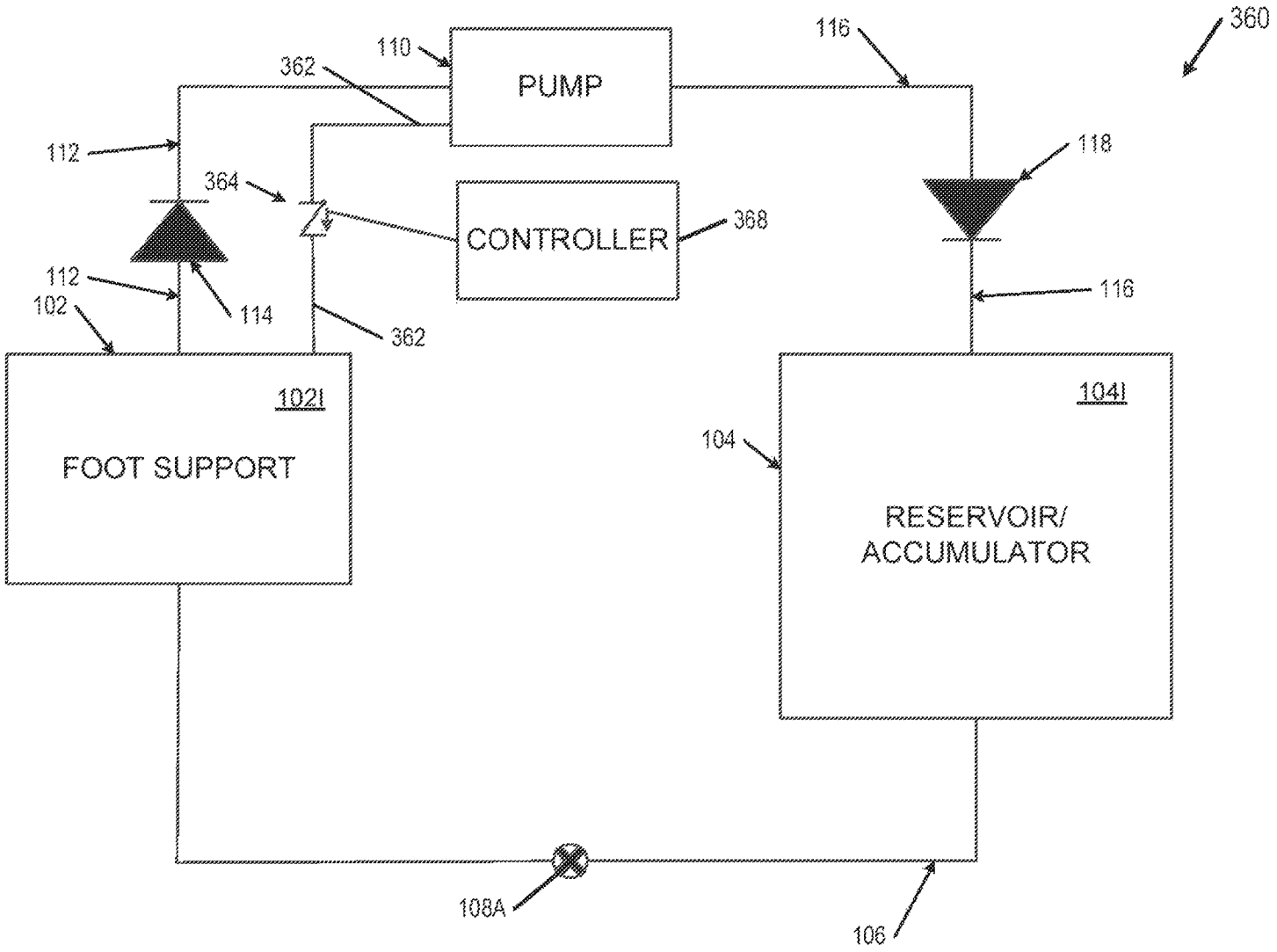

FIG. 3G schematically illustrates another example fluid-tight foot support system 360 in accordance with some examples of this invention. When the same reference numbers are used in FIG. 3G as used in other figures, the same or similar components are being referred to, and the component as used in FIG. 3G may have any of the various structures, options, features, alternatives, and the like as used for that reference number in the description of the component above. Optionally, if desired, fluid-tight foot support system 360 may be a closed system (e.g., a system that does not intake/receive fluid (e.g., gas) from an external source (such as the ambient atmosphere, a pump, a compressor, etc.) and/or does not release fluid (e.g., gas) to the external environment). As shown in FIG. 3G, this fluid-tight foot support system 360 includes a foot support bladder 102 that has an interior chamber 102I, and the foot support bladder 102 may be sized and shaped for supporting at least a portion of a wearer's foot (e.g., some or all of a plantar surface of a wearer's foot, such as any one or more of: at least a portion of a heel region of a wearer's foot, at least a portion of a midfoot/arch region of a wearer's foot, at least a portion of a forefoot region of a wearer's foot, an entire foot, etc.). A first fluid transfer line 112 extends from the foot support bladder 102 to a pump 110 (e.g., a foot-activated pump), and a first valve 114 is provided in the first fluid transfer line 112 to control flow of fluid within first fluid transfer line 112. More specifically, the first valve 114 allows fluid to move from the foot support bladder 102 to the pump 110 but inhibits fluid from moving from the pump 110 back into the foot support bladder 102 via the first fluid transfer line 112.

A second fluid transfer line 116 extends between the pump 110 and a fluid reservoir 104 (which holds a volume of fluid within an internal chamber 104I thereof and/or which may be formed as a fluid-filled bladder). A second valve 118 provided in the second fluid transfer line 116 allows fluid to move from the pump 110 to the fluid reservoir 104 but inhibits fluid from moving from the fluid reservoir 104 back into the pump 110 via the second fluid transfer line 116.

A third fluid transfer line 106 extends between the fluid reservoir 104 and the foot support bladder 102. A fluid flow controller 108A (e.g., which may include a manually and/or electronically controlled "on-off" switch or valve 108A) is included in the third fluid transfer line 106 to control flow of fluid between the fluid reservoir 104 and the foot support bladder 102 via the third fluid transfer line 106. In use, this switch or valve 108A may be operated and configured to change the third fluid transfer line 106 between an open condition and a closed condition. In the open condition, the switch or valve 108A allows free fluid transfer between the foot support bladder 102 and the fluid reservoir 104 via the third fluid line 106, e.g., in a manner to equalize fluid pressures in the foot support bladder 102 and the fluid reservoir 104 and/or otherwise change pressures in components 102 and 104, e.g., as described above. The switch or valve 108A may include a manually activated switch or an electronically activated switch, e.g., of the various types described above, including manual switches, wireless electronic controlled switches (e.g., controllable by a wireless input system, such as cellular telephone 170), wired switches, etc. As some options or alternatives, the switch 108A may be positioned and configured to physically pinch the third fluid transfer line 106 closed to place the third fluid transfer line 106 in the closed condition (e.g., if the third fluid transfer line 106 includes a plastic or flexible tube component or portion).

The above noted parts of this example foot support system 360, e.g., foot support bladder 102, first fluid transfer line 112, pump 110, first valve 114, second fluid transfer line 116, fluid reservoir 104, second valve 118, third fluid transfer line 106, and/or manually or electronically controlled switch 108A, may have any of the structures, features, and/or variations for the similar parts described above and/or may function in any of the various manners described above (e.g., to place the foot support bladder 102 and/or fluid reservoir 104 under different pressure conditions and change between the different pressure conditions). The foot support system 360 of FIG. 3G also could include one or more additional fluid reserve reservoirs, e.g., of the types described above as reserve reservoir 120, 120A-120N in FIGS. 3A-3D. Additionally or alternatively, switch 108A may be controlled to allow adjustment of relative pressures between the foot support bladder 102 and fluid reservoir 104.

Foot support system 360 of the example of FIG. 3G further includes a fourth fluid transfer line 362 extending between the pump 110 and the foot support bladder 102 (in fluid communication between the interior chambers of these two parts). A third valve 364 is provided in this fourth fluid transfer line 362. This third valve 364 allows fluid to move from the pump 110 to the foot support bladder 102 under certain conditions but inhibits fluid from moving from the foot support bladder 102 into the pump 110 via the fourth fluid transfer line 362. This third valve 364 may constitute a check valve that opens when fluid pressure in the pump 110 and/or the fourth fluid transfer line 362 exceeds fluid pressure in the foot support bladder 102 by a first pressure differential amount (e.g., corresponding to the "crack pressure" of third valve 364). In use, if the volume and pressure of fluid being moved by pump 110 during a step cycle is not sufficient to open valve 118 and move the fluid into the fluid reservoir 104, that fluid can return to the foot support bladder 102 via line 362 and valve 364. Also, valve 364 can allow fluid that leaks through valve 118 into second fluid transfer line 116 and pump 110 (if any) to be returned into the foot support bladder 102 (and potentially be pumped back out of the foot support bladder 102 during a future step cycle). A controller 368 may be provided, e.g., to change/control the pressure at which valve 364 opens (or "cracks") to return fluid to the foot support bladder 102 via fluid transfer line 362. The controller 368 may be controlled manually (e.g., by a switch with which the user can interact), electronically (e.g., via a cellular telephone or other input device), automatically (e.g., via a computer controller), etc. As another potential feature, the controller 368 may be used to change the crack pressure of valve 364 depending on the foot support bladder 102's "hardness" setting (e.g., depending on whether the foot support bladder 102 is in a high pressure foot support condition, a low pressure foot support condition, and/or an intermediate pressure foot support condition).

Figure 3H:
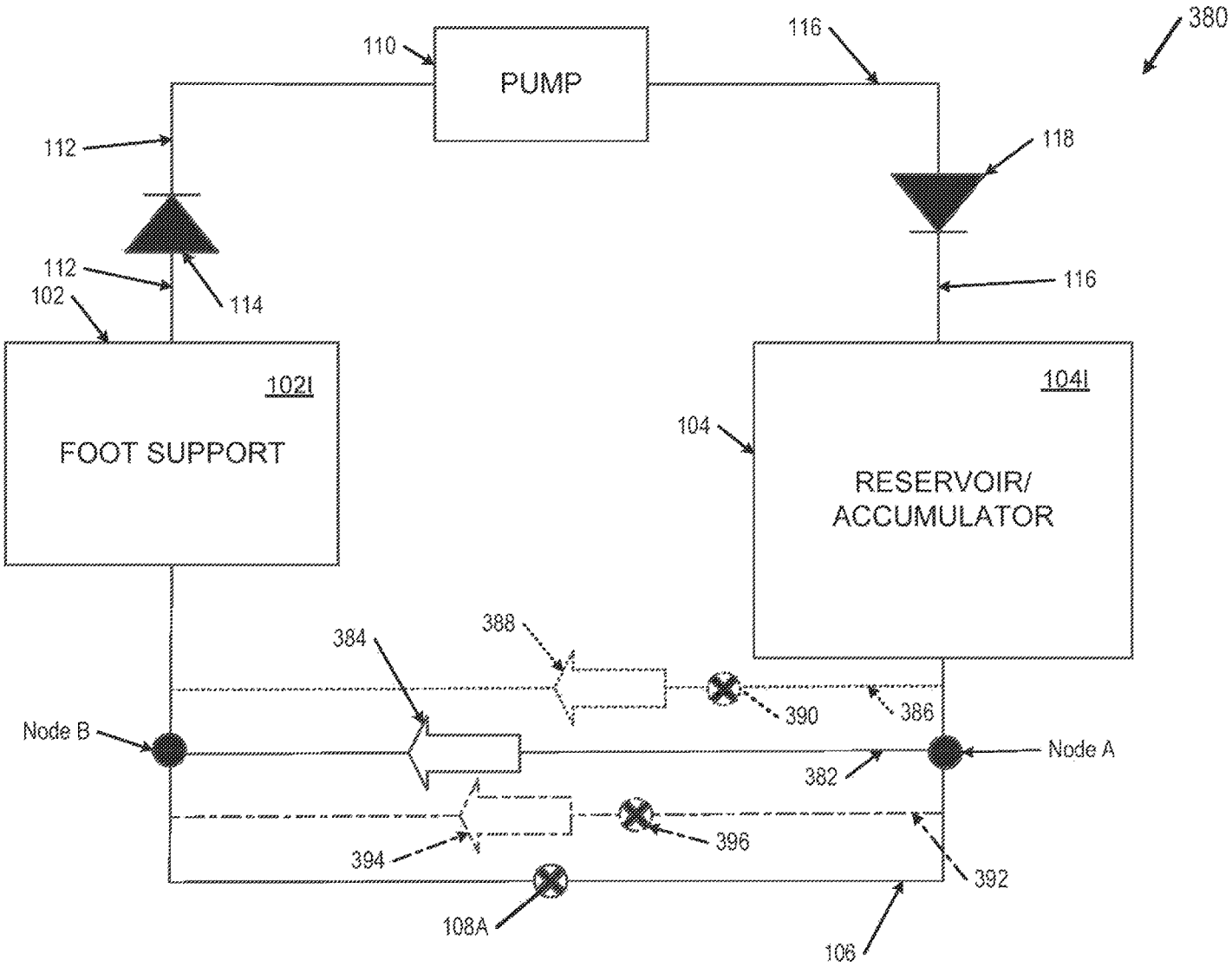

FIG. 3H schematically illustrates additional example fluid-tight foot support systems 380 in accordance with some aspects and examples of this invention. When the same reference numbers are used in FIG. 3H as used in other figures, the same or similar components are being referred to, and the component as used in FIG. 3H may have any of the various structures, options, features, alternatives, and the like as used for that reference number in the description of the component above.

One example foot support system is shown by the solid lines in FIG. 3H (and ignoring, for now, the broken line and dot-dash line features). This foot support system 380 includes: (a) a foot support bladder 102 for supporting at least a portion of a wearer's foot; (b) a pump 110 (e.g., a foot-activated pump); (c) a first fluid transfer line 112 extending between the foot support bladder 102 and the pump 110; (d) a first valve 114 (e.g., a check valve) in the first fluid transfer line 112, wherein the first valve 114 allows fluid to move from the foot support bladder 102 to the pump 110 but inhibits fluid from moving from the pump 110 into the foot support bladder 102 via the first fluid transfer line 112; (e) a fluid reservoir 104; (f) a second fluid transfer line 116 extending between the pump 110 and the fluid reservoir 104; (g) a second valve 118 (e.g., a check vale) in the second fluid transfer line 116, wherein the second valve 118 allows fluid to move from the pump 110 to the fluid reservoir 104 but inhibits fluid from moving from the fluid reservoir 104 into the pump 110 via the second fluid transfer line 116; (h) a third fluid transfer line 106 extending between the fluid reservoir 104 and the foot support bladder 102; and (i) a first fluid flow controller 108A (e.g., which may include a switch or valve) to control flow of fluid between the fluid reservoir 104 and the foot support bladder 102 via the third fluid transfer line 106. To this point, the parts described above for the system 380 of FIG. 3H are similar to those described with respect to other examples and embodiments of the invention, and these parts may have any of the structures, features, options, and/or alternatives for the various similar parts described above.

This example foot support system 380 further includes a fourth fluid transfer line 382 extending between the fluid reservoir 104 and the foot support bladder 102. FIG. 3H shows this fourth fluid transfer line 382 as a line extending from Node A to Node B in the third fluid transfer line 106 to "by-pass" the first fluid flow controller 108A in the third fluid transfer line 106 (e.g., the fourth fluid transfer line 382 may be arranged in parallel with the third fluid transfer line 106). A first check valve 384 is located in the fourth fluid transfer line 382.

In operation, the foot support system 380 of FIG. 3H operates to change the pressure in the foot support bladder 102 between a high pressure foot support condition and a low pressure foot support condition. The crack pressure of the first check valve 384 is selected to set a first pressure differential between the pressure in the foot support bladder 102 and the pressure in the fluid reservoir 104. When the first fluid flow controller 108A is in the open configuration (e.g., the third fluid transfer line 106 is open), fluid can freely flow from the foot support bladder 102 to the fluid reservoir 104 (via first and second fluid transfer lines 112, 116) and back to the foot support bladder 102 via the third fluid transfer line 106 (and through the open switch or valve of first fluid flow controller 108A). In this configuration, once at steady state, the fluid pressure is substantially constant throughout the system 380 (e.g., at about 25 psi), which corresponds to the high pressure foot support configuration for the foot support bladder 102 in this example foot support system 380.

When the first fluid flow controller 108A is changed to the closed configuration (e.g., by pinching a flexible plastic fluid line closed, by closing a valve or switch, etc.), fluid can no longer flow through first fluid flow controller 108A from the fluid reservoir 104 to the foot support bladder 102 via third fluid transfer line 106. Once this closed configuration is first selected for fluid flow controller 108A, fluid is pumped from the foot support bladder 102 via pump 110 to the fluid reservoir 104, thereby decreasing the pressure in the foot support bladder 102 and increasing the pressure in fluid reservoir 104. Because the third fluid transfer line 106 is closed at fluid flow controller 108A, as pressure increases, the fluid moves into the fourth fluid transfer line 382 until it reaches the first check valve 384. The crack pressure of the first check valve 384 can be selected to provide a desired pressure differential between the foot support bladder 102 and the reservoir bladder 104, and this crack pressure and/or pressure differential determines the pressure setting of the foot support bladder 102 at its lower pressure foot support configuration. For example, a first check valve 384 may be selected having (or adjusted to have) a crack pressure of 10 psi (e.g., as some ranges, the crack pressure may be within a range from 2 psi to 40 psi, and in some examples, from 5 psi to 35 psi, or from 7.5 psi to 30 psi, or even from 10 psi to 25 psi). The pump 110 will continue moving fluid from the foot support bladder 102 to the fluid reservoir 104 until pressure in the fluid reservoir 104 and fourth fluid transfer line 382 reaches the crack pressure of first check valve 384 (e.g., when the fluid reservoir 104 and fourth fluid transfer line 382 have a pressure 10 psi higher than the pressure in foot support bladder 102 in this illustrated example). At that time, the first check valve 384 will open and allow fluid to move through it until the pressure differential on opposite sides of the first check valve 384 reaches a level where the first check valve 384 again closes. This first check valve 384 may open in response to pressure changes at every step, if necessary, to maintain the pressure differential across first check valve 384 and to maintain the foot support bladder 102 at the desired, lower pressure foot support condition.

To return the foot support system 380 to the higher pressure foot support condition, the user interacts with first fluid flow controller 108A (e.g., open the valve, un-pinch a fluid tube, etc.) to allow fluid to flow through the third fluid transfer line 106 and through first fluid flow controller 108A. This action increases pressure in the foot support bladder 102 (and decreases pressure in the fluid reservoir 104). The first fluid flow controller 108A may be left open for a sufficient amount of time to equalize pressure between foot support bladder 102 and fluid reservoir 104 (and throughout the overall system 380), or it may be closed, if desired, at some intermediate pressure condition.

The above example describes switching the foot support system 380 between two discrete conditions, i.e., a high pressure foot support condition (e.g., at 25 psi foot support) and a low pressure foot support condition (e.g., at 10 psi foot support). Additional foot support pressure conditions may be made available in such systems 380, if desired, by providing an adjustable valve 384 in fourth fluid transfer line 382 (e.g., a valve having an adjustable crack pressure).

As yet other examples, additional foot support pressure conditions may be made available in such systems 380, if desired, by providing additional fluid transfer lines to by-pass the first fluid flow controller 108A in the third fluid transfer line 106. FIG. 3H shows an example of a foot support system 380 with three foot support pressure level conditions or configurations by combining the additional broken line features in FIG. 3H with the solid line features in that figure (and ignoring, for now, the dot-dash line features). More specifically, the broken lines in FIG. 3H further show that the system 380 may include a fifth fluid transfer line 386 extending between the fluid reservoir 104 and the foot support bladder 102 (e.g., in a manner that "by-passes" the first fluid flow controller 108A in the third fluid transfer line 106 and "by-passes" the first check valve 384 in the fourth fluid transfer line 382). A second check valve 388 is located in the fifth fluid transfer line 386. This second check valve 388 may be selected (or adjusted) to have a crack pressure different from (and optionally lower than) the crack pressure of the first check valve 384. The fifth fluid transfer line 386 in this example further includes a fluid flow controller 390, which may be part of the same fluid flow controller 108A as in the third fluid transfer line 106 (e.g., operated by the same switch or valve, operated to pinch off a flexible fluid line, etc.) or may be a separate controller from fluid flow controller 108A.

In operation, the foot support system 380 shown as the combined solid and broken lines in FIG. 3H operates to change the pressure in the foot support bladder 102 between a high pressure foot support condition, a medium pressure foot support condition, and a low pressure foot support condition. The crack pressure of the second check valve 388 in this example is selected to set a first pressure differential between the pressure in the foot support bladder 102 and the pressure in the fluid reservoir 104 (e.g., to provide a medium pressure foot support condition in the foot support bladder 102), and the crack pressure of the first check valve 384 in this example is selected to set a second pressure differential between the pressure in the foot support bladder 102 and the pressure in the fluid reservoir 104 (e.g., to provide a low pressure foot support condition). Thus, in this example, the crack pressure of the second check valve 388 is lower than the crack pressure of the first check valve 384.

When the first fluid flow controller 108A of the system 380 (including the solid and broken line components) is in the open configuration (e.g., the third fluid transfer line 106 is open), fluid can freely flow from the foot support bladder 102 to the fluid reservoir 104 (via first and second fluid transfer lines 112, 116) and back to the foot support bladder 102 via the third fluid transfer line 106 (and through the open switch or valve of first fluid flow controller 108A). In this configuration, once at steady state, the fluid pressure is substantially constant throughout the system 380 (e.g., at about 25 psi), which corresponds to the high pressure foot support configuration for the foot support bladder 102 in this example foot support system 380.

To change to the medium pressure foot support condition, the first fluid flow controller 108A is changed to the closed configuration (e.g., by pinching a flexible plastic fluid line closed, by closing a valve or switch, etc.). In this configuration, fluid can no longer flow through first fluid flow controller 108A from the fluid reservoir 104 to the foot support bladder 102 via third fluid transfer line 106. When this closed configuration for controller 108A is first selected, fluid is pumped from the foot support bladder 102 via pump 110 to the fluid reservoir 104, thereby decreasing the pressure in the foot support bladder 102 and increasing the pressure in fluid reservoir 104. Because the third fluid transfer line 106 is closed at controller 108A, as pressure increases, the fluid moves: (a) into the fourth fluid transfer line 382 until it reaches the first check valve 384 and (b) into the fifth fluid transfer line 386 until it reaches the second check valve 388. Because the crack pressure of the second check valve 388 is less than the crack pressure of the first check valve 384 in this example, the pressure increases in the fluid reservoir 104 and fluid transfer lines 382 and 386 until the crack pressure of the second check valve 388 is reached. The crack pressure of the second check valve 388 can be selected to provide a desired pressure differential between the foot support bladder 102 and the reservoir bladder 104, which determines the pressure setting of the foot support bladder 102 at its medium pressure foot support configuration. For example, second check valve 388 may have a crack pressure of 5 psi (e.g., as some ranges, this crack pressure may be within a range from 1.5 psi to 38 psi, and in some examples, from 4 psi to 32 psi, or from 6 psi to 26 psi, or even from 8 psi to 20 psi) and first check valve 384 may have a crack pressure of 10 psi. The pump 110 will continue moving fluid from the foot support bladder 102 to the fluid reservoir 104 until pressure in the fluid reservoir 104, the fourth fluid transfer line 382, and the fifth fluid transfer line 386 reaches the crack pressure of second check valve 388 (e.g., when the fluid reservoir 104 and fourth fluid transfer line 382 have a pressure 5 psi higher than the pressure in foot support bladder 102 in this illustrated example). At that time, the second check valve 388 will open and allow fluid to move through it until the pressure differential on opposite sides of the second check valve 388 reaches a level where the second check valve 388 again closes. Because of its higher (e.g., 10 psi) crack pressure, first check valve 384 remains closed throughout. Second check valve 388 may open in response to pressure changes at every step, if necessary, to maintain the pressure differential across second check valve 388 and to maintain the foot support bladder 102 at the desired, medium pressure foot support condition.

To change this example foot support system 380 to the low pressure foot support condition, the second fluid flow controller 390 is controlled to close the fifth fluid transfer line 386 before second check valve 388 (e.g., by pinching off a flexible plastic tube of fifth fluid transfer line 386, by closing a valve or switch, etc.). Controller 108A remains in a closed condition. This action takes the fifth fluid transfer line 386 and the second check valve 388 out of the fluid flow path, and leaves the fourth fluid transfer line 382 and the first check valve 384 in the fluid flow path. In the same manner as described above, with both fluid flow controllers 108A and 390 closed, fluid can no longer flow through first fluid flow controller 108A and/or the second fluid flow controller 390 from the fluid reservoir 104 to the foot support bladder 102 via the third fluid transfer line 106 and the fifth fluid transfer line 386, respectively. When this low pressure foot support configuration is first selected, fluid is pumped from the foot support bladder 102 via pump 110 to the fluid reservoir 104, thereby further decreasing the pressure in the foot support bladder 102 and further increasing the pressure in fluid reservoir 104. Because the third and fifth fluid transfer lines 106, 386 are closed by controllers 108A and 390, respectively, as pressure increases, the fluid moves into the fourth fluid transfer line 382 until it reaches the first check valve 384. The crack pressure of the first check valve 384 can be selected to provide a desired pressure differential between the foot support bladder 102 and the reservoir bladder 104, which determines the pressure setting of the foot support bladder 102 at its low pressure foot support configuration. For example, first check valve 384 may have a crack pressure of 10 psi (e.g., this crack pressure may be within a range from 2 psi to 40 psi, and in some examples, from 5 psi to 35 psi, or from 7.5 psi to 30 psi, or even from 10 psi to 25 psi). The pump 110 will continue moving fluid from the foot support bladder 102 to the fluid reservoir 104 until pressure in the fluid reservoir 104 and fourth fluid transfer line 382 reaches the crack pressure of first check valve 384 (e.g., when the fluid reservoir 104 and fourth fluid transfer line 382 have a pressure 10 psi higher than the pressure in foot support bladder 102 in this illustrated example). At that time, the first check valve 384 will open and allow fluid to move through it until the pressure differential on opposite sides of the first check valve 384 reaches a level where the first check valve 384 again closes. This first check valve 384 may open in response to pressure changes at every step, if necessary, to maintain the pressure differential across first check valve 384 and to maintain the foot support bladder 102 at the desired, low pressure foot support condition.

To return the foot support system 380 to the highest pressure foot support condition, the user interacts with first fluid flow controller 108A (e.g., open the valve, un-pinch a fluid tube, etc.) to allow fluid to flow through the third fluid transfer line 106 and through first fluid flow controller 108A. This action increases pressure in the foot support bladder 102 (and decreases pressure in the fluid reservoir 104). Additionally or alternatively, this action may open second fluid flow controller 390 (or the second fluid flow controller 390 may be opened separately, individually, and/or in a separate action (and/or with separate component parts) as used to open the first fluid flow controller 108A). The first fluid flow controller 108A may be left open for a sufficient amount of time to equalize pressure between foot support bladder 102 and fluid reservoir 104 (and throughout the overall system 380), or it optionally may be closed earlier, if desired, at some intermediate pressure.

Any desired number of additional pressure settings and additional foot support pressure configurations/levels can be provided without departing from this invention, e.g., by adding additional branches of fluid transfer lines, check valves (with different crack pressures), and fluid flow controllers. For example, FIG. 3H shows another example foot support system 380 in which the components in the solid lines, the broken lines, and the dot-dash lines are combined into a single foot support system 380. The dash-dot lines of FIG. 3H add a sixth fluid transfer line 392, a third check valve 394, and a third fluid flow controller 396 into the system 380 (e.g., in a manner that "by-passes" the first fluid flow controller 108A in the third fluid transfer line 106, the first check valve 384 in the fourth fluid transfer line 382, and the second check valve 388 in the fifth fluid transfer line 386). For this example system 380, assume that the crack pressure of first check valve 384 is greater than the crack pressure of second check valve 388, which is greater than the crack pressure of third check valve 394. If the check valves 384, 388, 394, . . . are selected with different crack pressures and if the fluid flow controllers 108A, 390, 396, . . . are operable individually and/or in appropriate combinations, this system 380 may provide:

(a) a high pressure foot support condition (e.g., in which all of fluid flow controllers 108A, 390, and 396 are open), (b) a medium-high pressure foot support condition (e.g., in which fluid flow controller 108A is closed, fluid flow controllers 390 and 396 remain open, and when pressure adequately increases, fluid flows through sixth fluid transfer line 392 and through third check valve 394 (which has the lowest crack pressure in this example)), (c) a medium-low pressure foot support condition (e.g., in which fluid flow controllers 108A and 396 are closed, fluid flow controller 390 remains open, and when pressure adequately increases, fluid flows through fifth fluid transfer line 386 and through second check valve 388 (which has the mid-range crack pressure in this example)), and (d) a low pressure foot support condition (e.g., in which fluid flow controllers 108A, 396, and 390 are closed, and when pressure adequately increases, fluid flows through the fourth fluid transfer line 382 and through first check valve 384 (which has the highest crack pressure in this example)).

Additional by-pass fluid transfer lines, check valves, and fluid flow controllers can be provided, if desired, to provide additional levels of foot support pressure in a similar manner.

While FIG. 3H schematically illustrates three separate fluid flow controllers 108A, 390, and 396 (one in each of fluid transfer lines 106, 386, 392, respectively), a single fluid flow controller may be used, if desired, to control fluid flow among any one or more of these various lines to correspond to the processes described above. As a more specific example, akin to the regulator 108 structure shown in FIG. 2A, two or more of the various fluid lines may meet at a common area and a single switching mechanism (e.g., switch 108S) may be used to selectively pinch off or open the desired fluid transfer line or lines for a given pressure setting. Check valves (including check valves 384, 388, 394, and any others disclosed herein), as that term is used herein, include any valve structure used to allow fluid flow in only one direction. Examples include, but are not limited to: ball check valves, diaphragm check valves, swing check valves, tilting disc check valves, clapper valves, flapper valves, stop-check valves, lift check valves, in-line check valves, duckbill valves, etc.

The fluid-tight foot support systems 360 and/or 380 of FIGS. 3G and 3H, respectively, may be incorporated into a sole structure and/or an article of footwear, e.g., in any of the various manners described above and/or described below. As some more specific examples, the fluid-tight foot support systems 360 and/or 380 may be engaged with at least one of an upper or a sole structure for the article of footwear, and the foot support bladder 102 may be positioned to support at least a portion of a plantar surface of a wearer's foot, e.g., in any of the various manners described above. As some more specific examples, again referring to the various example structures described above, the pump 110 may be positioned in the footwear structure to be activated by a wearer's foot (e.g., one or more of the wearer's toes, the wearer's heel, etc.) during a step. At least some portion of the fluid reservoir 104 (and optionally all or substantially all of it) may be engaged with the footwear upper (e.g., as shown in FIGS. 1A and 1B above). Additionally or alternatively, at least some portion of the fluid reservoir 104 (and optionally all or substantially all of it) may be engaged with the sole structure of the article of footwear (e.g., as shown in FIGS. 2A-2F above, optionally with a major surface of the reservoir bladder 104 vertically stacked (e.g., underlying) and/or directly facing a major surface of the foot support bladder 102). Any desired manner of incorporating the parts of fluid-tight foot support systems 360 and/or 380 into an article of footwear may be used without departing from aspects of this invention.

Figure 4A:
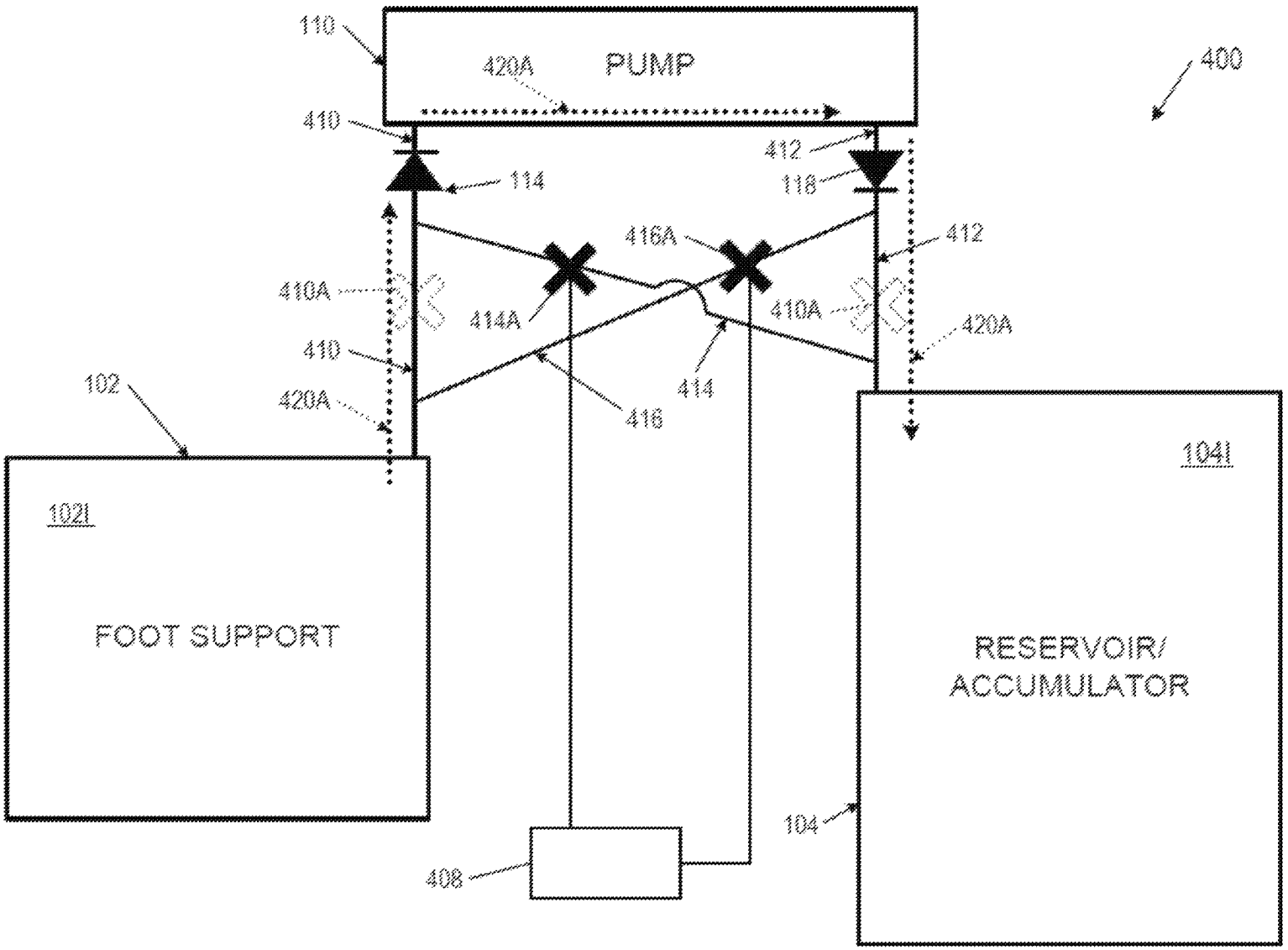
FIGS. 4A-4C illustrate various features of fluid transfer and/or fluid pressure changes in accordance with various examples and aspects of this invention.
Figure 4B:
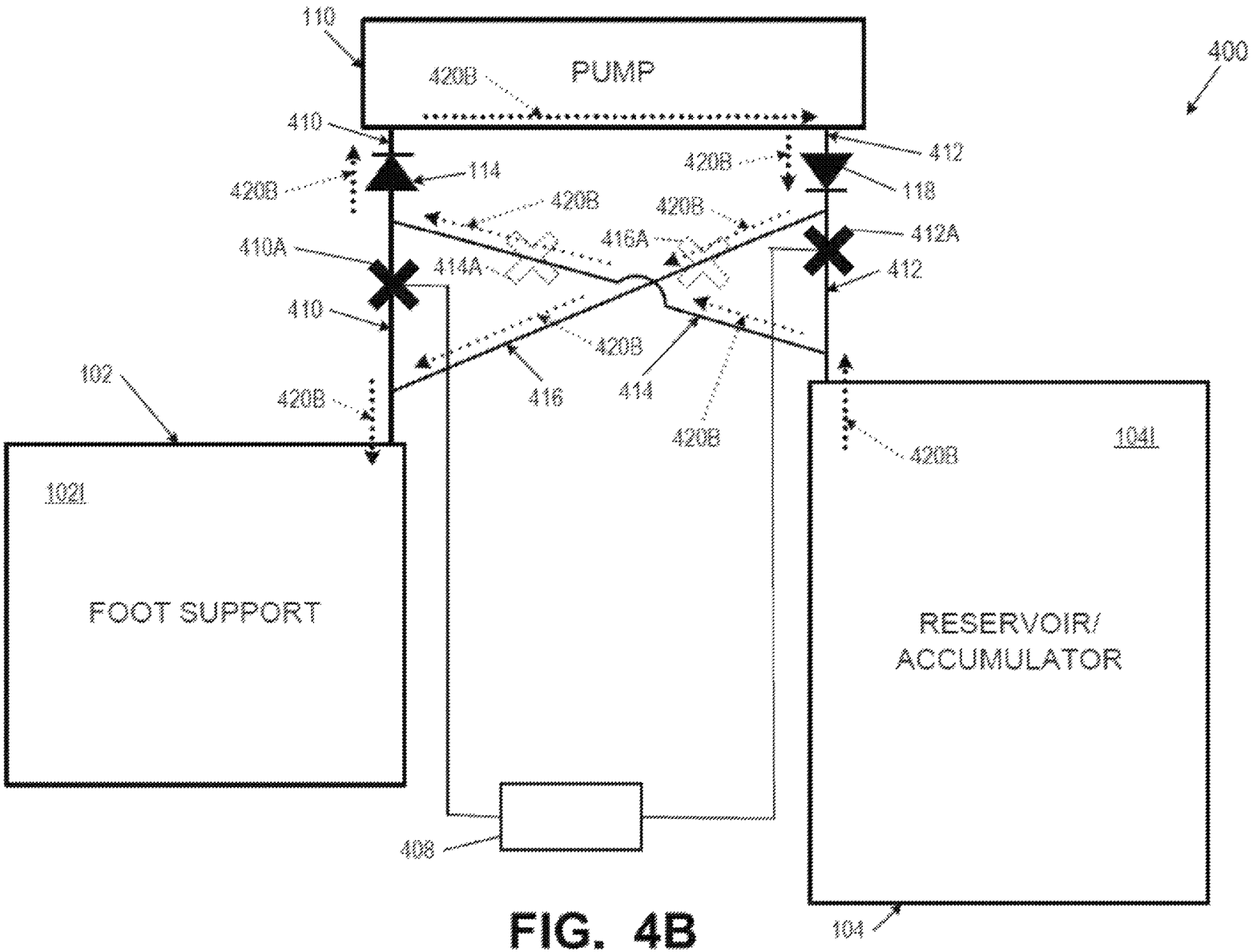
Figure 4C:
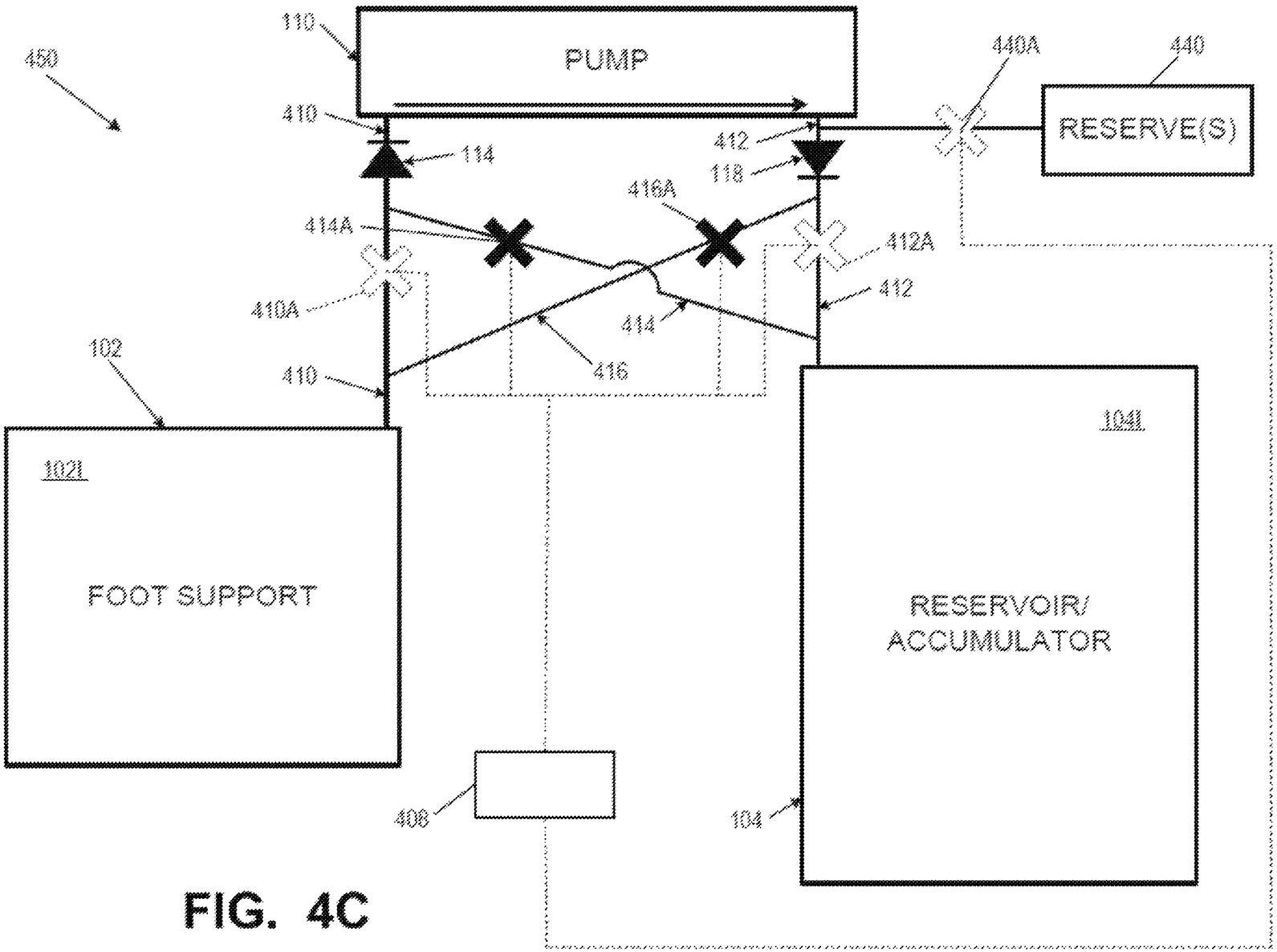

FIGS. 4A-4C illustrate other example foot support systems 400 that may be used in accordance with at least some examples of this invention (e.g., in footwear structures of the types shown in FIGS. 1B, 2B, 2E, and 2F). These example foot support systems 400 may include foot support bladders 102 and fluid reservoir bladders 104, e.g., of the various types described above (e.g., and potentially in the various orientations and arrangements described above). When the same reference numbers are used in FIGS. 4A-4C as those used in FIGS. 1A-3H above, the same or similar parts are being referred to, and a complete/detailed description of the various parts may be omitted. This example foot support system 400 includes a foot support bladder 102 for supporting at least a portion of a wearer's foot and fluid reservoir bladder 104. A fluid flow direction regulating system 408 is provided in this system 400 for controlling movement of fluid (e.g., a gas): (a) in a first path from the foot support bladder 102 into the fluid reservoir bladder 104 (FIG. 4A) or (b) in a second path from the fluid reservoir bladder 104 into the foot support bladder 102 (FIG. 4B) through the action of a pump 110 (which may be a "step activated" pump/bulb pump of the various types described above). The fluid flow direction regulating system 408 may be a physical switch type structure (e.g., akin to components 108 and 108A above), an electronically controlled valve or other system (e.g., including input device 170 and wired or wireless communication), structure(s) to physically "pinch off" or close off fluid paths in a bladder structure, and/or the like.

A first fluid transfer line 410 extends between the foot support bladder 102 and the pump 110, and a first valve 114 (e.g., a one-way valve) is provided allowing fluid transmission from the foot support bladder 102 to the pump 110 via the first fluid transfer line 410 but not allowing fluid transmission from the pump 110 back into the foot support bladder 102 (e.g., via the first fluid transfer line 410). A second fluid transfer line 412 extends between the pump 110 and the fluid reservoir 104, and a second valve 118 (e.g., a one-way valve) is provided allowing fluid transmission from the pump 110 to the fluid reservoir 104 via the second fluid transfer line 412 but not allowing fluid transmission from the fluid reservoir 104 back into the pump 110 (e.g., via the second fluid transfer line 412). A third fluid transfer line 414 extends between the first fluid transfer line 410 and the second fluid transfer line 412, and a separate, fourth fluid transfer line 416 extends between the first fluid transfer line 410 and the second fluid transfer line 412. The various fluid transfer lines 410-416 may be formed as an integral part of the overall system 400 that forms the bladders 102 and/or 104 and/or that forms the pump 110 (e.g., by thermoforming/thermoplastic sheet welding processes as described above).

In this example system 400, when fluid moves through both the first path and the second path, the fluid moves in a direction from the first fluid transfer line 410, through the pump 110, to the second fluid transfer line 412. More specifically, FIG. 4A schematically shows the system 400 arrangement and configuration for providing fluid flow through the first fluid flow path identified above. As shown in FIG. 4A, in this configuration, the fluid flow direction regulating system 408 is structured and arranged such that, in the first path, fluid is drawn from the foot support bladder 102, into the first fluid transfer line 410, through the valve 114, through the pump 110, into the second fluid transfer line 412, through the valve 118, and into the fluid reservoir 104. Note fluid flow arrows 420A. In this configuration and fluid flow path arrangement, the third fluid transfer line 414 and the fourth fluid transfer line 416 are maintained in a closed condition, e.g., by stop members 414A and 416A, respectively, and fluid flow direction regulating system 408. The volume(s) of the flow line(s) (e.g., the volume of fluid transfer lines 412, 414, and/or 416) may be selected such that when the fluid reservoir bladder 104 reaches a desired pressure, the amount of fluid moved by the pump 110 in a single pump cycle (e.g., a single user step) will be insufficient to overcome the pressure across valve 118 (and thus insufficient to move more fluid into fluid reservoir 104).

FIG. 4B, on the other hand, shows the fluid flow direction regulating system 408 structured and arranged to allow fluid flow through the second path identified above. In this configuration and fluid path arrangement: fluid is drawn from the fluid reservoir 104, into the second fluid transfer line 412, into the third fluid transfer line 414 (because of stop member 412A and/or valve 118 prevents flow into pump 110 via line 412), and into the first fluid transfer line 410. From there, because of stop member 410A, the fluid moves through valve 114, through line 410, through the pump 110, into the second fluid transfer line 412, and through valve 118. From there, because of the stop member 412A, the fluid moves into the fourth fluid transfer line 416, into the first fluid transfer line 410, and into the foot support bladder 102 (because stop member 410A prevents flow into pump 110 via line 410). Note fluid flow arrows 420B. In this arrangement: (a) the first fluid transfer line 410 is maintained in a closed condition (via stop member 410A) at a location so as to prevent fluid from flowing from the third fluid transfer line 414 directly into the foot support bladder 102 via the first fluid transfer line 410 and (b) the second fluid transfer line 412 is maintained in a closed condition (via stop member 412A) at a location so as to prevent fluid from flowing from the second fluid transfer line 412 directly into the fluid reservoir 104 via the second fluid transfer line 412. As shown in FIGS. 4A and 4B, in this foot support system 400: (a) the third fluid transfer line 414 is connected to the first fluid transfer line 410 at a location such that fluid flowing from the third fluid transfer line 414 into the first fluid transfer line 410 along the second path will pass through the first one-way valve 114 before reaching the pump 110 and/or (b) the fourth fluid transfer line 416 is connected to the second fluid transfer line 412 at a location such that fluid flowing from the pump 110 into the second transfer line 412 along the second path will pass through the second one-way valve 118 before reaching the fourth fluid transfer line 416.

The foot support systems 400 and fluid control systems 408 shown in FIGS. 4A and 4B allow a simple, unidirectional pump (e.g., a blub type pump activated by a user's foot during a step) to be used to move fluid in two distinct overall directions in the system 400. More specifically, as described above, the system 400 can allow fluid to always enter pump 110 through one inlet area (e.g., via fluid transfer line 410) and always exit pump 110 through one outlet area (e.g., via fluid transfer line 412) while still permitting fluid transfer from foot support bladder 102 to fluid reservoir bladder 104 or from fluid reservoir bladder 104 to foot support bladder 102. Opening all of stop members 410A, 412A, 414A, 416A can allow the fluid pressure to be equalized across the system 400.

FIG. 4C shows another foot support system 450, which is similar in many respects to the system 400 shown in FIGS. 4A and 4B (e.g., with a uni-directional pump 110 able to move fluid along the two paths/directions described above). The same or similar features to those described above are shown by the same reference numbers as used in FIGS. 1A-4B, and a more detailed explanation of these same or similar features is omitted Like the systems 100, 200, 260, 280, 300 of FIGS. 3A-3D, however, the system 450 includes one or more reserve reservoir bladders 440, e.g., of the types described above with respect to element(s) 120, 120A, 120B, . . . 120N of FIGS. 3A-3D. The reserve reservoir bladder(s) 450 can be selectively controlled by stop member(s) 440A (e.g., via flow control system 408) to allow changes in the pressure in foot support bladder 102, as described above (e.g., discrete, stepwise pressure changes), at least when the system 450 is in the first fluid path arrangement shown in FIG. 4A (with stop members 414A and 416A closed). Opening all of stop members 410A, 412A, 414A, 416A, 440A can allow the pressure to be equalized across the system 450. Additionally or alternatively, one or more (and optionally all) of the reserve reservoir bladder(s) 440 could be replaced with one or more in-line regulators, e.g., of the types described in conjunction with FIGS. 3E and 3F (e.g., in line 410, 412, 414, and/or 416).

Various embodiments of the invention described above include a foot support bladder 102 and a fluid reservoir 104 (e.g., potentially also a fluid-filled bladder) in which pressure may be varied. The foot support bladder 102 and fluid reservoir 104 may have any desired sizes and shapes without departing from this invention. As some more specific examples, foot support bladders 102 may have a volume (V 102) ranging from 50 $cm^3$ to 400 $cm^3$, and in some examples, from 75 $cm^3$ to 350 $cm^3$, from 85 $cm^3$ to 325 $cm^3$, or even from 100 $cm^3$ to 300 $cm^3$. Additionally or alternatively, fluid reservoir 104 may have a volume ($V_{104}$) ranging from 50 $cm^3$ to 500 $cm^3$, and in some examples, from 75 $cm^3$ to 450 $cm^3$, from 100 $cm^3$ to 400 $cm^3$, or even from 120 $cm^3$ to 350 $cm^3$. The relative volumes of the foot support bladder 102 to the fluid reservoir 104 may satisfy one or more of the following: (a) $V_{104}=0.85\times V_{102}$ to $2.5\times V_{102}$, (b) $V_{104}=1\times V_{102}$ to $2\times V_{102}$, and/or (c) $V_{104}=1.2\times V_{102}$ to $1.8\times V_{102}$.

Figure 5A:
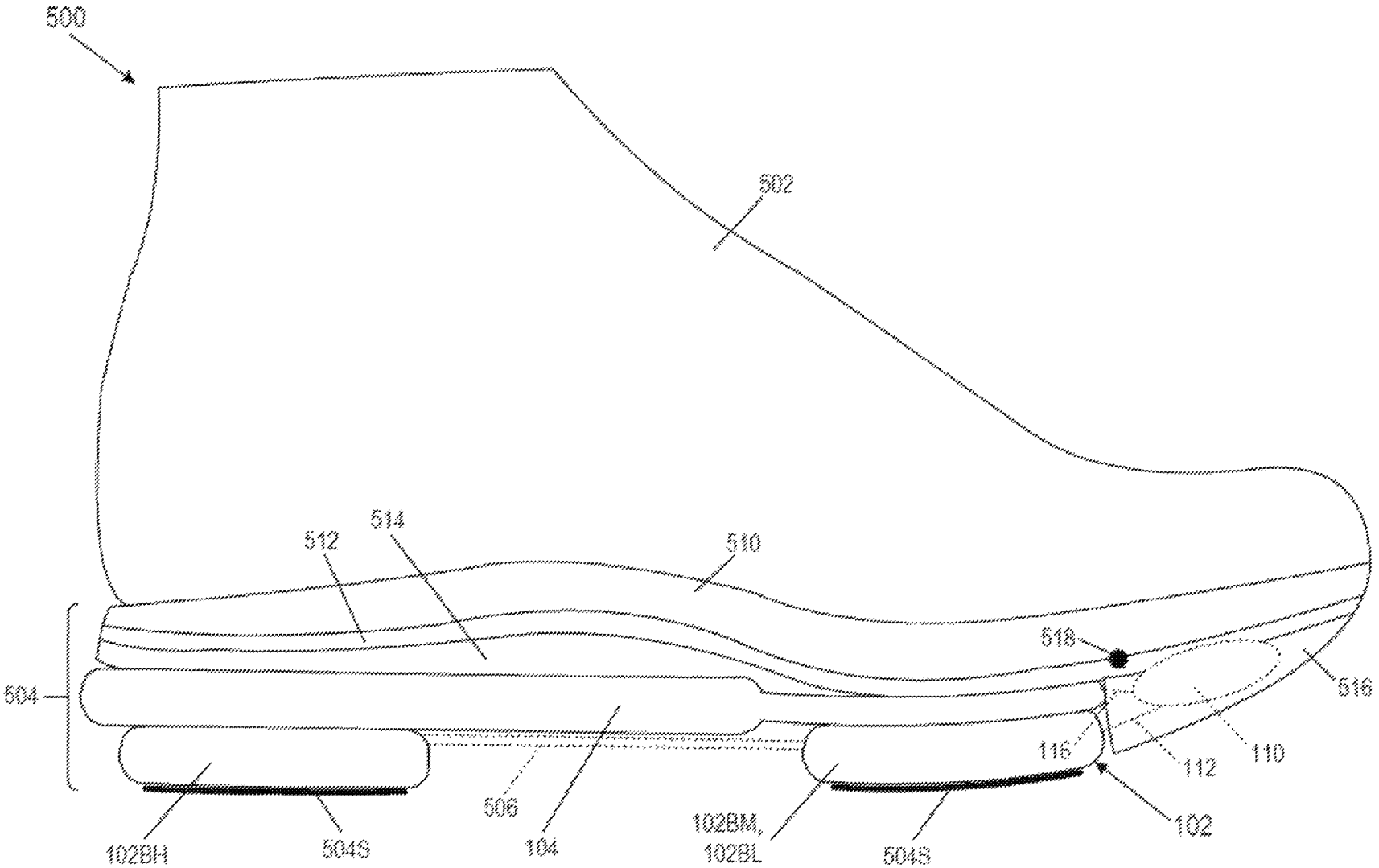
FIGS. 5A and 5B illustrate various features of another example article of footwear in accordance with various examples and aspects of this invention.
Figure 5B:
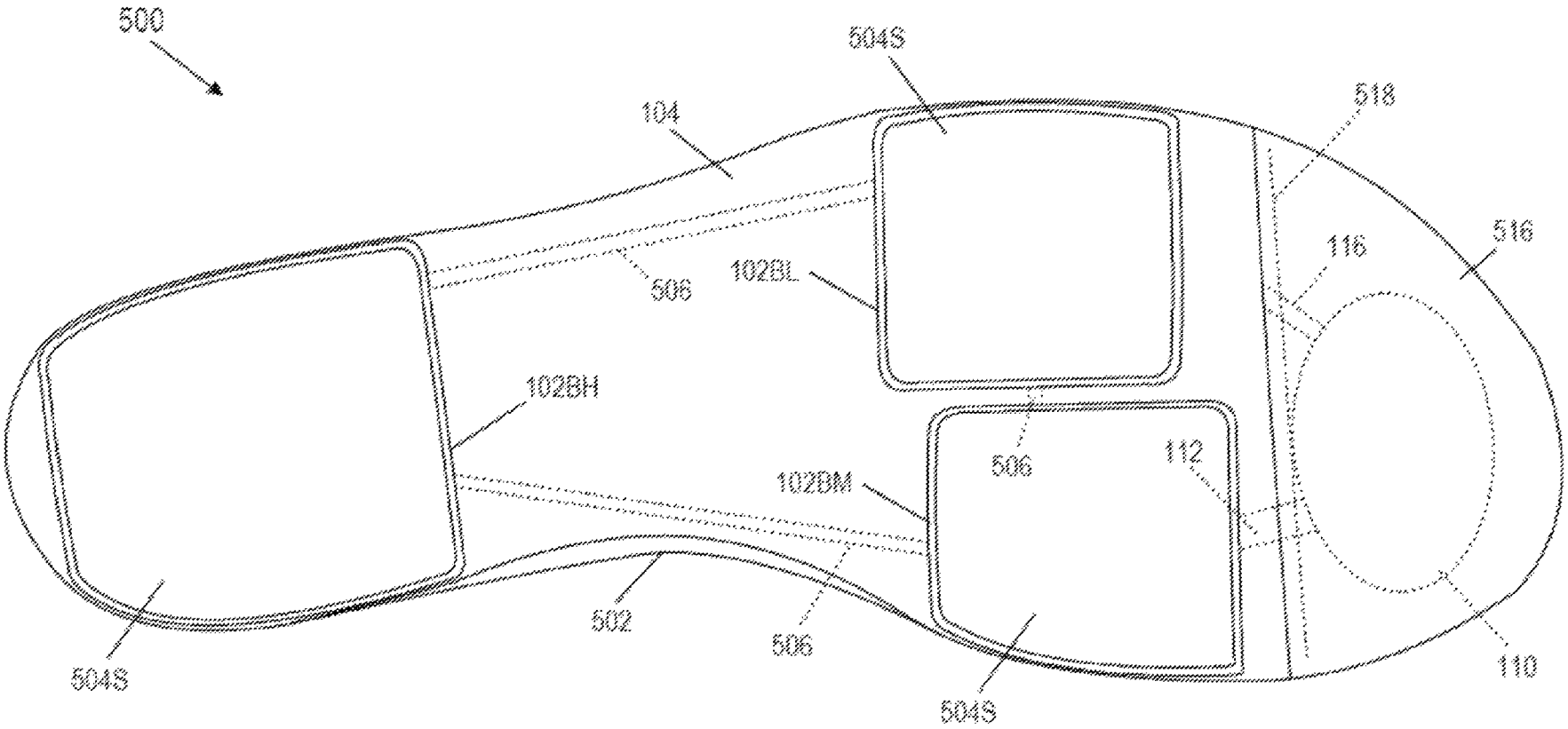

FIGS. 5A and 5B include side and bottom views, respectively, of another example article of footwear structure 500 in accordance with at least some examples of this invention. The article of footwear 500 includes an upper 502, which may have any desired construction, structure, and/or numbers of parts and may be made by any desired methods, including conventional constructions, structures, numbers of parts, and/or production methods and/or any constructions, structures, numbers of parts, and/or production methods described above. The article of footwear 500 further includes a sole structure 504 engaged with the upper 502, e.g., by adhesives or cements, by mechanical connectors, and/or by sewing or stitching (and may be connected in conventional manners as are known and used in the art). Certain features of this sole structure 504 will be described in more detail below.

FIGS. 5A and 5B further illustrate that this example sole structure 504 includes a foot support system, e.g., which may have any of the structures, features, characteristics, properties, fluid flow connections, and/or options of the foot support systems described above in conjunction with FIGS. 1A-4C. In this specifically illustrated example footwear structure 500, the foot support system includes one or more fluid reservoir bladders 104 (one fluid reservoir bladder 104 shown in FIGS. 5A and 5B) in fluid communication with one or more (three shown in FIGS. 5A and 5B) foot support bladders 102. In this illustrated example footwear structure 500, the fluid reservoir bladder(s) 104 is vertically stacked and located above the foot support bladder(s) 102 in the footwear structure 500, akin to the structure described above in conjunction with FIG. 2F, although a vertically inverted arrangement (with one or more foot support bladder(s) 102 vertically stacked above one or more reservoir bladder(s) 104 in the footwear structure 500) also may be used without departing from the invention.

As noted above, FIGS. 5A and 5B illustrate that the foot support bladder 102 of this example includes three separated foot support bladder regions. Specifically, a heel oriented foot support bladder 102BH is located in a heel support region of the article of footwear 500, a lateral forefoot support bladder 102BL is located in a lateral forefoot support region of the article of footwear 500 (e.g., vertically beneath and positioned to support at least the fifth metatarsal head region of a wearer's foot and optionally the third and/or fourth metatarsal head areas as well), and a medial forefoot support bladder 102BM is located in a medial forefoot support region of the article of footwear 500 (e.g., vertically beneath and positioned to support at least the first metatarsal head region of a wearer's foot and optionally the second and/or third metatarsal head areas as well). More or fewer individual foot support bladders 102 may be provided at any additional or alternative desired positions in a footwear structure, including one or more nested arrangements of foot support bladders 102, without departing from this invention. These figures further show one or more outsole elements 504S (e.g., made of rubber, TPU, or conventional outsole material) engaged with and/or otherwise covering an outer major surface of each of the foot support bladders 102BH, 102BL, and 102BM (although more, fewer, and/or different types of outsole elements 504S may be provided, if desired, including no separate outsole elements). If desired, an outsole element 504S could be provided that completely covers at least the bottoms (and optionally at least some portion(s) of the sides) of the fluid-filled bladders of the foot support system (e.g., bladders 102BH, 102BL, 102BM, and 104). The outsole element(s) 504S, when present, made be made from materials and/or include suitable structures to enhance traction with a contact surface, e.g., traction features suitable for the desired end use of the article of footwear 500.

While other options are possible, FIGS. 5A and 5B illustrate the three bladder regions 102BH, 102BL, and 102BM interconnected with one another (shown by broken fluid transfer lines 506). In this manner, unless valving, pressure regulators, or other pressure control means are provided (e.g., in one or more of lines 506), the pressures in the three bladder regions 102BH, 102BL, and 102BM will be the same. As other options, when multiple bladder regions are provided as part of a foot support bladder 102 in an individual foot support system, any desired number of the bladder regions (e.g., two or more of 102BH, 102BL, and 102BM) may be maintained at the same pressure and/or any desired number of the bladder regions (e.g., one or more of 102BH, 102BL, and 102BM) may be maintained at a different pressure from any one or more of the other bladder regions. Check valves (or other appropriate fluid flow control components) may be provided (e.g., in the fluid transfer lines 506) to enable control of fluid flow and/or pressures in the various bladder regions (e.g., 102BH, 102BL, and 102BM).

FIGS. 5A and 5B further schematically show a pump chamber 110 in fluid communication with one foot support bladder (bladder region 102BM in this illustrated example) via line 112 and in fluid communication with the fluid reservoir bladder 104 via line 116. Additionally or alternatively, the pump chamber 110 may be in direct fluid communication with one or both of foot support bladder regions 102BH and/or 102BL (or with any other present foot support bladder 102). Although not shown in FIGS. 5A and 5B, a reserve reservoir (e.g., like 120) and fluid flow connections to that reserve reservoir (e.g., like those described above with respect to FIGS. 1A-4C) may be provided in the sole structure 504. Any one or more of bladder regions 102BH, 102BL, and 102BM also may have a connection to fluid reservoir bladder(s) 104 (e.g., akin to line 106 described above). When more than one of bladder regions 102BH, 102BL, and 102BM has a separate connection line to pump chamber 110 and/or fluid reservoir bladder 104, that separate connection line may include its own individual (and own individually controllable) valve 114 and/or stop member 108M.

FIGS. 5A and 5B further show additional components that may be included in sole structures 504 and/or articles of footwear 500 in accordance with at least some examples of this invention. As shown in FIG. 5A, the footwear 500/sole structure 504 may include a midsole element 510 (e.g., made of a foam material) that extends to support all or any desired portion/proportion of a wearer's foot. As another option, component 510 may constitute a strobel member and/or other bottom component of the upper 502. A moderator plate 512 (e.g., made from carbon fiber, thermoplastic polyurethane, fiberglass, etc.) may be provided beneath the midsole (or strobel) element 510, and this moderator plate 512 may extend to support all or any desired portion/proportion of a wearer's foot. Optionally, if desired, moderator plate 512 and midsole element 510 may be vertically inverted so that the moderator plate 512 will be located closer to the wearer's foot than is the midsole element 510. An additional foam material 514 (or other filler material) may be provided vertically beneath the moderator plate 512, e.g., to provide a base for engaging the fluid reservoir bladder 104 and/or to fill in any gaps or holes through the sole structure 504 due to the structures of the various other parts. The parts 502, 510, 512, 514, 104, and/or 102 may be engaged together in any desired manner, such as via adhesives or cements, mechanical connectors, sewing or stitching, etc.

The forward toe portion 516 of this example sole structure 504 may be constructed, e.g., akin to the area shown in FIGS. 1C and 1D, to include an interior chamber for housing the pump chamber 110 and/or to include a pump activator 126 for activating the pump chamber 110 (by movement of a wearer's foot). The exterior or cover material defining the chamber of the forward toe portion 516 may be made of foam, rubber, TPU, or any other desired material (including materials conventionally used in the footwear arts). Additionally or alternatively, as also shown in FIGS. 1C and 1D, any one or more of the midsole (or strobel) element 510, the moderator plate 512, and/or the additional foam material 514 may be structured to allow the wearer's foot to compress the pump chamber 110. As some more specific examples, any one or more of the midsole (or strobel) element 510, the moderator plate 512, and/or the additional foam material 514 may be sufficiently flexible to allow the wearer's foot to move downward to compress the pump chamber and/or one or more hinges, flex lines, or other structures can be provided to enable relative rotational movement between the forward toe area and the forefoot area of any one or more of the midsole (or strobel) element 510, the moderator plate 512, and/or the additional foam material 514 (e.g., upward and downward about axis 518). Thus, the forward toe area of any one or more of the midsole (or strobel) element 510, the moderator plate 512, and/or the additional foam material 514 may function as the pump activator 126 shown in FIGS. 1C and 1D. As another option or example, if desired, the pump chamber 110 and/or pump activator 126 structure may be provided at another area of the sole structure 504 and/or article of footwear 500, such as in the heel area.

The fluid pressure change control systems and/or fluid flow control systems described above with respect to FIGS. 3A-4C can be used in conjunction with footwear structures and/or footwear components of any types including any of the types described above, e.g., with respect to FIGS. 1A-2F, 5A, and 5B, and they may be arranged in the footwear structures and/or footwear components in any of the various manners described above.

III. CONCLUSION

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. A foot support system, comprising:

a foot support bladder for supporting at least a portion of a wearer's foot;

a pump;

a first fluid transfer line extending between the foot support bladder and the pump;

a first valve in the first fluid transfer line, wherein the first valve allows fluid to move from the foot support bladder to the pump but inhibits fluid from moving from the pump into the foot support bladder via the first fluid transfer line;

a fluid reservoir in fluid communication with an outlet of the pump to receive fluid from the pump;

a fluid flow controller selectively switchable between an open configuration and a closed configuration and configured to selectively open and close fluid flow between the fluid reservoir and the foot support bladder;

a second fluid transfer line extending between the pump and the foot support bladder; and a second valve in the second fluid transfer line, wherein the second valve allows fluid to move from the pump to the foot support bladder but inhibits fluid from moving from the foot support bladder into the pump via the second fluid transfer line.

2. The foot support system according to claim 1, wherein the fluid flow controller includes a switch or valve configured to change a third fluid transfer line between an open condition and a closed condition, wherein in the open condition, the fluid flow controller allows fluid transfer between the foot support bladder and the fluid reservoir via the third fluid transfer line.

3. The foot support system according to claim 2, wherein the fluid flow controller includes a wireless input device for receiving an electronic signal, and wherein the switch or valve includes an electronically controlled switch or valve that changes the third fluid transfer line between the open condition and the closed condition.

4. The foot support system according to claim 3, further comprising an electronic device including a user input system and a wireless transmitter in electronic communication with the wireless input device.

5. The foot support system according to claim 2, wherein the switch or valve of the fluid flow controller includes a switch configured to physically pinch the third fluid transfer line closed to place the third fluid transfer line in the closed condition.

6. The foot support system according to claim 1, wherein the fluid flow controller includes a manually activated switch or valve.

7. The foot support system according to claim 1, wherein the second valve is a check valve that opens when fluid pressure in the pump exceeds fluid pressure in the foot support bladder by a first pressure differential amount.

8. The foot support system according to claim 1, wherein the foot support system is a closed system.

9. A foot support system, comprising:

a foot support bladder for supporting at least a portion of a wearer's foot;

a pump;

a first fluid transfer line extending between the foot support bladder and the pump;

a first valve in the first fluid transfer line, wherein the first valve allows fluid to move from the foot support bladder to the pump but inhibits fluid from moving from the pump into the foot support bladder via the first fluid transfer line;

a second fluid transfer line extending between the pump and the foot support bladder;

a second valve in the second fluid transfer line, wherein the second valve allows fluid to move from the pump to the foot support bladder but inhibits fluid from moving from the foot support bladder into the pump via the second fluid transfer line; and a fluid reservoir in fluid communication with an outlet of the pump to receive fluid from the pump.

10. The foot support system according to claim 9, wherein the foot support bladder includes a foot support surface sized and shaped to support an entire plantar surface of a wearer's foot.

11. The foot support system according to claim 9, wherein the foot support bladder includes a foot support surface sized and shaped to support at least a heel portion of a wearer's foot.

12. The foot support system according to claim 9, wherein the foot support bladder includes a foot support surface sized and shaped to support at least a portion of a forefoot portion of a wearer's foot.

13. The foot support system according to claim 9, wherein the second valve is configured to open when fluid pressure in the pump and/or the second fluid transfer line exceeds fluid pressure in the foot support bladder by a first pressure differential amount.

14. The foot support system according to claim 9, further comprising a fluid flow controller including a switch or valve selectively switchable between an open configuration and a closed configuration and configured to selectively open and close fluid flow between the fluid reservoir and the foot support bladder.

15. An article of footwear, comprising:

an upper;

a sole structure engaged with the upper; and a foot support system engaged with at least one of the upper or the sole structure, wherein the foot support system includes: (a) a foot support bladder for supporting at least a portion of a wearer's foot, (b) a pump, (c) a first fluid transfer line extending between the foot support bladder and the pump, (d) a first valve in the first fluid transfer line, wherein the first valve allows fluid to move from the foot support bladder to the pump but inhibits fluid from moving from the pump into the foot support bladder via the first fluid transfer line, (e) a second fluid transfer line extending between the pump and the foot support bladder, (f) a second valve in the second fluid transfer line, wherein the second valve allows fluid to move from the pump to the foot support bladder but inhibits fluid from moving from the foot support bladder into the pump via the second fluid transfer line, and (g) a fluid reservoir in fluid communication with an outlet of the pump to receive fluid from the pump.

16. The article of footwear according to claim 15, wherein the foot support system further includes a fluid flow controller selectively switchable between an open configuration and a closed configuration and configured to selectively open and close fluid flow between the fluid reservoir and the foot support bladder.

17. The article of footwear according to claim 15, wherein the pump is positioned to be activated by a wearer's foot during a step.

18. The article of footwear according to claim 15, wherein at least a portion of the fluid reservoir is engaged with the sole structure.

19. The article of footwear according to claim 15, wherein the fluid reservoir includes a major surface that directly faces a major surface of the foot support bladder.

20. The article of footwear according to claim 19, wherein at least a portion of the major surface of the fluid reservoir underlies at least a portion of the major surface of the foot support bladder in the sole structure.

* * * * *